US011248396B2

(12) United States Patent
Lammers et al.

(10) Patent No.: US 11,248,396 B2
(45) Date of Patent: Feb. 15, 2022

(54) SEALED KEEPER SENSORS

(71) Applicant: Amesbury Group, Inc., Amesbury, MA (US)

(72) Inventors: Tracy Lammers, Sioux Falls, SD (US); Gary E. Tagtow, Sioux Falls, SD (US); Matt Halbersma, Brandon, SD (US); Michael Lee Anderson, Sioux Falls, SD (US)

(73) Assignee: Amesbury Group, Inc., Edina, MN (US)

( * ) Notice: Subject to any disclaimer, the term of this patent is extended or adjusted under 35 U.S.C. 154(b) by 787 days.

(21) Appl. No.: 16/041,235

(22) Filed: Jul. 20, 2018

(65) Prior Publication Data

US 2019/0024412 A1 Jan. 24, 2019

Related U.S. Application Data

(60) Provisional application No. 62/536,150, filed on Jul. 24, 2017, provisional application No. 62/641,093, filed on Mar. 9, 2018.

(51) Int. Cl.
*E05B 47/00* (2006.01)
*E05B 15/02* (2006.01)

(52) U.S. Cl.
CPC ..... *E05B 47/0046* (2013.01); *E05B 15/0205* (2013.01); *E05B 47/0038* (2013.01); (Continued)

(58) Field of Classification Search
CPC ..... E05B 47/0046; E05B 15/0205; E05B 2047/0058; E05B 2047/0069; E05B 2047/0095; E05B 15/0073
See application file for complete search history.

(56) References Cited

U.S. PATENT DOCUMENTS 832,539 A 10/1906 Davis
4,420,794 A 12/1983 Anderson
(Continued)

FOREIGN PATENT DOCUMENTS

CA 2645471 A1 5/2009
CA 2631521 11/2009
(Continued)

OTHER PUBLICATIONS sdcsecurity.com—Latch and Deadbolt Monitoring Strikes; printed from http://www.sdcsecurity.com/monitor-strike-kits2.htm, 2 pages, Feb. 2016.

(Continued)

*Primary Examiner* — Kristina R Fulton
*Assistant Examiner* — Christopher F Callahan
(74) *Attorney, Agent, or Firm* — Merchant & Gould P.C.

(57) ABSTRACT

An electronic keeper includes a housing defining a battery chamber and an actuator chamber. An actuator is at least partially disposed within the actuator chamber. The actuator includes a strike and a magnet, and is pivotable between a first position and a second position relative to the housing. The actuator is also biased towards the first position. The electronic keeper also includes a senor disposed within the battery chamber. When a locking element is in contact with the strike, the actuator pivots from the first position towards the second position so that the magnet moves relative to the sensor.

18 Claims, 17 Drawing Sheets

(52) U.S. Cl.
CPC ..... *E05B 2047/0058* (2013.01); *E05B 2047/0069* (2013.01); *E05B 2047/0095* (2013.01)

(56) References Cited

U.S. PATENT DOCUMENTS

| | | | | |
|---|---|---|---|---|
| 4,465,997 | A | 8/1984 | Hines | |
| 4,540,208 | A | 9/1985 | Logan, Jr. | |
| 4,595,220 | A | 6/1986 | Hanchett, Jr. | |
| 4,616,865 | A | 10/1986 | Mackle | |
| 4,683,741 | A | 8/1987 | Fields | |
| 4,717,909 | A | 1/1988 | Davis | |
| 5,257,841 | A | 11/1993 | Geringer | |
| 5,735,559 | A | 4/1998 | Frolov | |
| 5,757,269 | A | 5/1998 | Roth | |
| 5,825,288 | A | 10/1998 | Wojdan | |
| 5,946,726 | A | 9/1999 | Hotzl | |
| 5,987,818 | A | 11/1999 | Dabideen | |
| 6,035,676 | A | 3/2000 | Hudspeth | |
| 6,098,433 | A | 8/2000 | Maniaci | |
| 6,381,999 | B1 | 5/2002 | Doong | |
| 6,441,735 | B1 * | 8/2002 | Marko | E05B 45/083 340/542 |
| 6,568,726 | B1 | 5/2003 | Caspi | |
| 6,570,498 | B1 | 5/2003 | Frost | |
| 6,580,355 | B1 | 6/2003 | Milo | |
| 6,619,085 | B1 | 9/2003 | Hsieh | |
| 6,644,072 | B1 | 11/2003 | Hsieh | |
| 6,658,905 | B1 | 12/2003 | Hsieh | |
| 6,666,054 | B1 | 12/2003 | Hsieh | |
| 6,813,916 | B2 | 11/2004 | Chang | |
| 6,845,641 | B2 | 1/2005 | Hsieh | |
| 7,010,947 | B2 | 3/2006 | Milo | |
| 7,032,418 | B2 | 4/2006 | Matrin | |
| 7,121,605 | B2 * | 10/2006 | DePue | B60R 7/06 296/37.12 |
| 7,128,350 | B2 | 10/2006 | Eckerft | |
| 7,158,029 | B1 | 1/2007 | Martyn | |
| 7,388,742 | B2 | 6/2008 | Cargin, Jr. | |
| 7,690,230 | B2 | 4/2010 | Gray | |
| 8,269,627 | B2 | 9/2012 | Gore et al. | |
| 8,403,376 | B2 | 3/2013 | Greiner | |
| 8,624,736 | B2 | 1/2014 | Gore et al. | |
| 8,646,816 | B2 | 2/2014 | Dziurdzia | |
| 8,851,532 | B2 | 10/2014 | Geringer | |
| 8,922,370 | B2 | 12/2014 | Picard | |
| 9,157,902 | B2 | 10/2015 | Gore et al. | |
| 9,245,439 | B2 | 1/2016 | Lamb et al. | |
| 9,353,550 | B1 * | 5/2016 | Smith, III | E05B 41/00 |
| 9,933,243 | B2 | 4/2018 | Thibault et al. | |
| 9,959,745 | B2 | 5/2018 | Lamb et al. | |
| 10,228,266 | B1 | 3/2019 | McGruder et al. | |
| 10,234,307 | B1 | 3/2019 | McGruder et al. | |
| 2004/0011094 | A1 | 1/2004 | Hsieh | |
| 2004/0089037 | A1 | 5/2004 | Chang | |
| 2004/0112100 | A1 | 6/2004 | Matrin | |
| 2004/0159134 | A1 | 8/2004 | Eichenauer | |
| 2005/0044908 | A1 | 3/2005 | Min | |
| 2005/0231365 | A1 | 10/2005 | Tester | |
| 2007/0081309 | A1 | 4/2007 | Urushibara | |
| 2008/0000276 | A1 | 1/2008 | Huang | |
| 2008/0127686 | A1 | 6/2008 | Hwang | |
| 2008/0174951 | A1 | 7/2008 | Mundt | |
| 2008/0191499 | A1 | 8/2008 | Stein | |
| 2009/0066320 | A1 * | 3/2009 | Posey | E05B 63/0017 324/207.13 |
| 2009/0218832 | A1 | 9/2009 | Mackle | |
| 2009/0315669 | A1 | 12/2009 | Lang | |
| 2010/0313612 | A1 | 12/2010 | Eichenstein | |
| 2011/0015789 | A1 | 1/2011 | LaJeunesse | |
| 2013/0340491 | A1 | 12/2013 | Lambrou | |
| 2014/0062466 | A1 | 3/2014 | Thibault et al. | |
| 2014/0182343 | A1 | 7/2014 | Talpe | |
| 2014/0218167 | A1 | 8/2014 | Tseng | |
| 2014/0376978 | A1 | 12/2014 | Geringer | |
| 2015/0089804 | A1 | 4/2015 | Picard | |
| 2015/0170449 | A1 | 6/2015 | Chandler, Jr. | |
| 2015/0176311 | A1 | 6/2015 | Picard | |
| 2015/0267442 | A1 | 9/2015 | Zhang | |
| 2016/0372811 | A1 | 12/2016 | Yosui | |
| 2017/0207046 | A1 * | 7/2017 | Long | E05B 15/0205 |
| 2017/0234033 | A1 | 8/2017 | DeBoer et al. | |
| 2018/0051478 | A1 | 2/2018 | Tagtow et al. | |
| 2018/0155959 | A1 | 6/2018 | Hartung et al. | |
| 2019/0122530 | A1 | 4/2019 | Lamb et al. | |

FOREIGN PATENT DOCUMENTS

| | | | | |
|---|---|---|---|---|
| CA | 2645471 | C | 10/2016 | |
| CN | 2483477 | Y | 3/2002 | |
| CN | 203403733 | U | 1/2014 | |
| CN | 104386019 | A | 3/2015 | |
| DE | 19500054 | | 7/1996 | |
| EP | 2450509 | | 5/2012 | |
| FR | 2848593 | | 2/2005 | |
| JP | 64-083777 | | 3/1989 | |
| JP | 2006112042 | | 4/2006 | |
| JP | 2008002203 | | 1/2008 | |
| KR | 2011094706 | | 8/2011 | |
| WO | WO-0111166 | A2 * | 2/2001 | E05B 63/248 |
| WO | 2015/079290 | | 6/2015 | |

OTHER PUBLICATIONS doorking.com—Electric Locks—Strikes and Deadbolts; printed from https://www.doorking.com/access-control/electriclocks-strikes-deadbolts, 2 pages, Feb. 2016.

PCT International Search Report and Written Opinion in International Application PCT/US2017/047348, dated Jan. 15, 2018, 19 pages.

PCT Invitation to Pay Additional Fees in PCT Application PCT/US2017/047348, dated Nov. 15, 2017, 12 pages.

magneticlocks.net—Electric Strikes and Deadbolts; printed from https://www.magneticlocks.net/electric-strikes-and-deadbolls/electric-strikes.html, 8 pages, Feb. 2016.

PCT International Preliminary Reporton Patentability in International Application PCT/US2017/047348, dated Feb. 28, 2019, 11 pages.

* cited by examiner

SEALED KEEPER SENSORS

CROSS-REFERENCE TO RELATED APPLICATIONS

This application claims priority to and the benefit of U.S. Provisional Patent Application No. 62/536,150, filed on Jul. 24, 2017, and U.S. Provisional Patent Application No. 62/641,093, filed on Mar. 9, 2018, the disclosures of which are hereby incorporated by reference in their entireties.

INTRODUCTION

Deadbolts typically are operated by a user (e.g., with a key on an outside of the door or a thumbturn on the inside of the door) to secure a door against unwanted intrusions. Motorized deadbolt systems are also available. However, the electronics and battery connections of the motorized deadbolt systems are subject to corrosion when exposed to environmental conditions, such as humidity, temperature changes, and salt air environments.

SUMMARY

In an aspect, the technology relates to an electronic keeper including: a housing defining a battery chamber and an actuator chamber; an actuator at least partially disposed within the actuator chamber, wherein the actuator includes a strike and a magnet, wherein the actuator is pivotable between a first position and a second position relative to the housing; and wherein the actuator is biased towards the first position; and a senor disposed within the battery chamber, wherein when a locking element is in contact with the strike, the actuator pivots from the first position towards the second position so that the magnet moves relative to the sensor.

In an example, the housing includes a wall extending between the battery chamber and the actuator chamber, and the battery chamber is separate from the actuator chamber. In another example, the battery chamber is sealed to prevent exposure to corrosive conditions. In yet another example, the magnet defines an axis, and wherein the axis is substantially parallel to a depth of the wall. In still another example, a face plate is coupled to a first end of the housing, and the face plate defines an opening for access into the actuator chamber. In an example, the actuator is completely disposed within the actuator chamber, and the strike is positioned proximate the opening and the magnet is positioned proximate the sensor.

In another example, the opening is configured to at least partially receive the locking element to contact the strike within the actuator chamber. In yet another example, a strike plate is coupled to the face plate opposite the housing and proximate the opening, and the strike plate at least partially defines a lock volume configured to at least partially receive the locking element. In still another example, at least the strike of the actuator extends from the actuator chamber and into the lock volume when the actuator is in the first position. In an example, the actuator further includes a stop plate that the strike extends from, and when the actuator is in the first position, the stop plate at least partially engages the face plate. In another example, the actuator further includes a lever arm extending between the stop plate and the strike.

In yet another example, when the actuator is in the second position, the strike is completely disposed within the actuator chamber. In still another example, the actuator further includes a first member having the strike and a second member having the magnet, and wherein the first member is pivotably mounted within the actuator chamber and is pivotable in a first direction from the first position towards the second position, and the second member is pivotably mounted within the actuator chamber and is pivotable in an opposite second direction from the first position towards the second position. In an example, the first member further includes a stop plate that the strike extends from, and wherein the stop plate engages with the second member. In another example, when the actuator is in the first position, the strike is angled to receive the locking element rotating in a first direction, and the first direction is opposite to a second direction that the actuator pivots when moving from the first position towards the second position. In another example, the housing includes a back plate coupled to a second end of the housing opposite the face plate, and at least a portion of the back plate is secured to the housing by ultrasonic welding both a butt joint and a shear joint between the housing and the back plate.

In another aspect, the technology relates to an electronic keeper including: a first compartment configured to at least partially receive a locking element; an actuator disposed within the first compartment, wherein the actuator includes a strike and a magnet, and wherein the strike is configured to contact at least a portion of the locking element and move the magnet from a first position towards a second position; a second compartment separately sealed from the first compartment; and a sensor configured to detect the position of the magnet in at least one of the first position and the second position. In an example, the first compartment is separated from the second compartment by a wall, and the sensor and the magnet are both positioned proximate the wall.

In another aspect, the technology relates to an electronic keeper including: a housing defining a battery chamber and an actuator chamber; a strike plate extending from the housing, wherein the strike plate at least partially defines a lock volume; an actuator at least partially disposed within the actuator chamber, wherein the actuator includes a magnet and a strike, and wherein at least the strike of the actuator extends from the actuator chamber and into the lock volume when the actuator is in a first position; and a sensor disposed within the battery chamber, wherein when a locking element is in contact with the strike, the actuator is pivoted towards a second position so as to trigger the sensor by positioning the magnet in a predetermined position relative to the sensor. In an example, the actuator includes a first member having the strike and a separate second member having the magnet.

BRIEF DESCRIPTION OF THE DRAWINGS

There are shown in the drawings, examples which are presently preferred, it being understood, however, that the technology is not limited to the precise arrangements and instrumentalities shown.

DETAILED DESCRIPTION

Figure 1:
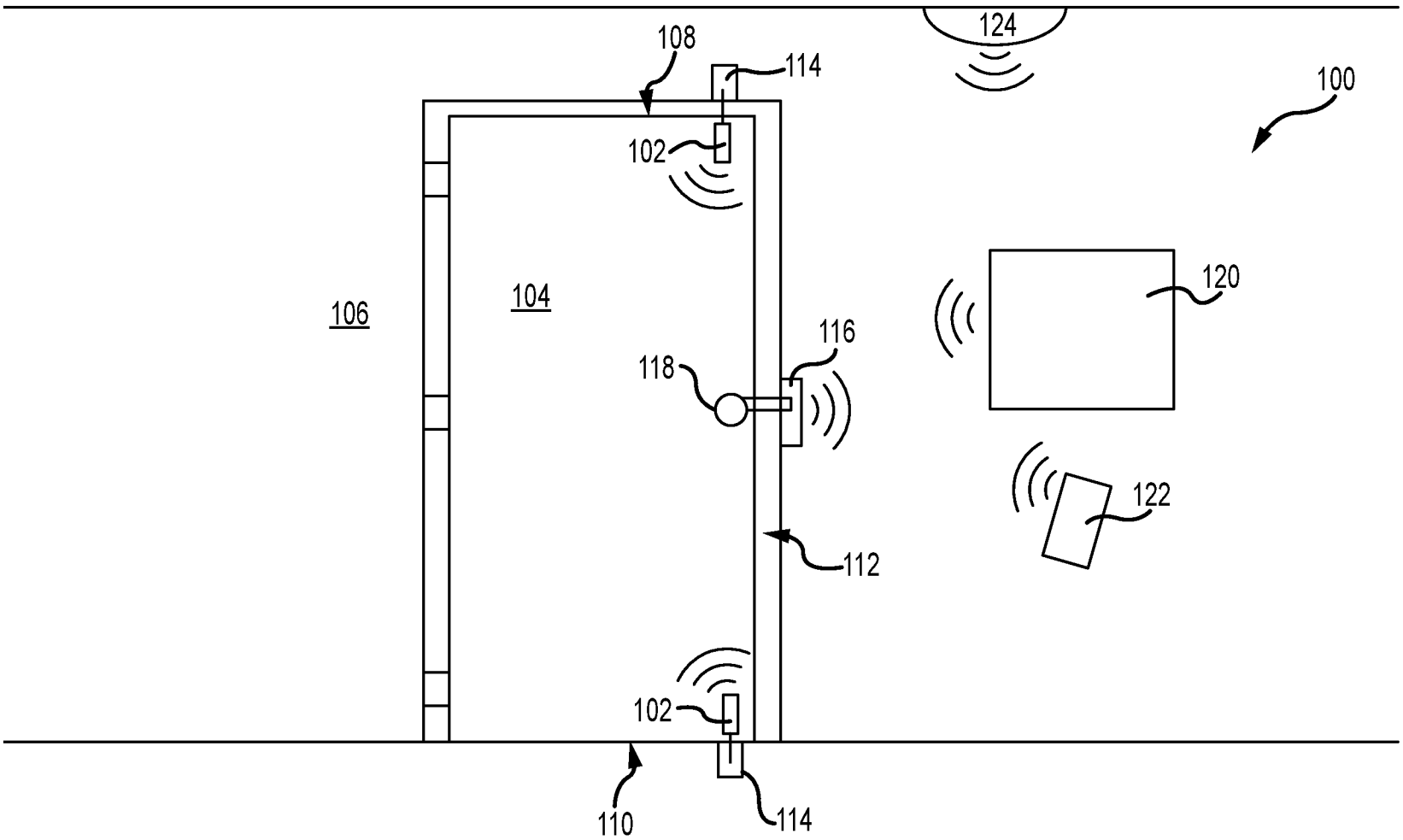
FIG. 1 is a schematic view of an electronic door lock system.

FIG. 1 depicts a schematic view of one example of a multi-point electric door lock system 100. The system 100 includes two electronic remote lock systems 102 installed in a door panel 104, for example, so as to extend a lock point into a portion of a frame 106 such as a head and/or a sill thereof. Alternatively, the electronic remote lock systems 102 may be installed in the frame 106 so as to extend the lock point into the door 104. Additionally, the placement and number of electronic remote lock systems 102 may be altered as required or desired for a particular application, for example, in pivoting doors, the electronic remote lock systems may be disposed so as to extend from a head 108, a sill 110, or a locking edge 112 (e.g., vertical edge) of the door 104.

In the example, the door panel 104 is a pivoting door; however, the electronic deadbolt remote lock systems described herein can be utilized in entry doors, sliding doors, pivoting patio doors, and any other door as required or desired. In sliding patio doors, the electronic remote lock systems 102 may have linearly extending locking elements that may extend from the head 108 or the sill 110 of the sliding door. If utilized on the locking edge 112 of a sliding door, the electronic remote lock system 102 may require a rotating hook-shaped locking element (e.g., a rhino-bolt) that would hook about a keeper so as to prevent retraction of the door 104.

In the example, each electronic remote lock system 102 is positioned to as to extend into a keeper 114. The keepers 114 may be standard keepers or electronic keepers that can detect the presence and/or absence of a locking element therein. The system 100 also includes an electronic keeper 116 configured to receive a locking element 118. The locking element 118 can be a standard deadbolt (e.g., manually actuated), as typically available on an entry or patio door and that linearly extends into the keeper 116, or may be an electronic deadbolt (e.g., electronically actuated). In other examples, the locking element 118 can be a pivoting mortise lock such as either a standard rhino-bolt or electronic rhino-bolt, as typically available on a sliding door and that rotates into the keeper 116. Examples of various electronic keepers 116 are described further below in reference to FIGS. 2-15B.

In one example, once the locking element 118 is actuated into the locking position, the electronic keeper 116 detects a position of the locking element 118 therein. A signal may be sent to the remotely located electronic remote lock systems 102, thus causing actuation thereof. At this point, the door 104 is now locked at multiple points. Unlocking of the locking element 118 is detected by the electronic keeper 116 (that is, the keeper 116 no longer detects the presence of the locking 118 therein) and a signal is sent to the remote electronic remote lock systems 102 causing retraction thereof, thus allowing the door 104 to be opened. Thus, the electronic keepers described herein may be utilized to create a robust multi-point locking system for a door and improving the security thereof.

In another example, the system 100 may include a controller/monitoring system, which may be a remote panel 120, which may be used to extend or retract the electronic remote lock systems 102, or which may be used for communication between the various electronic keepers 114 and remote lock systems 102. In other examples, the remote panel 120 may also be used to extend or retract the locking element 118, or which may be used for communication between the keeper 116 and the locking element 118. Alternatively or additionally, an application on a remote computer or smartphone 122 may take the place of, or supplement the remote panel 120. By utilizing a remote panel 120 and/or a smartphone 122, the electronic remote lock systems 102 and/or the locking element 118 may be locked or unlocked remotely, thus providing multi-point locking ability without the requirement for manual actuation of the locking element 118. Additionally, any or all of the components (e.g., electronic remote lock systems 102, keepers 114, 116, locking element 118, panel 120, and smartphone 122) may communicate either directly or indirectly with a home monitoring or security system 124. The communication between components may be wireless, as depicted, or may be via wired systems.

Figure 2C:
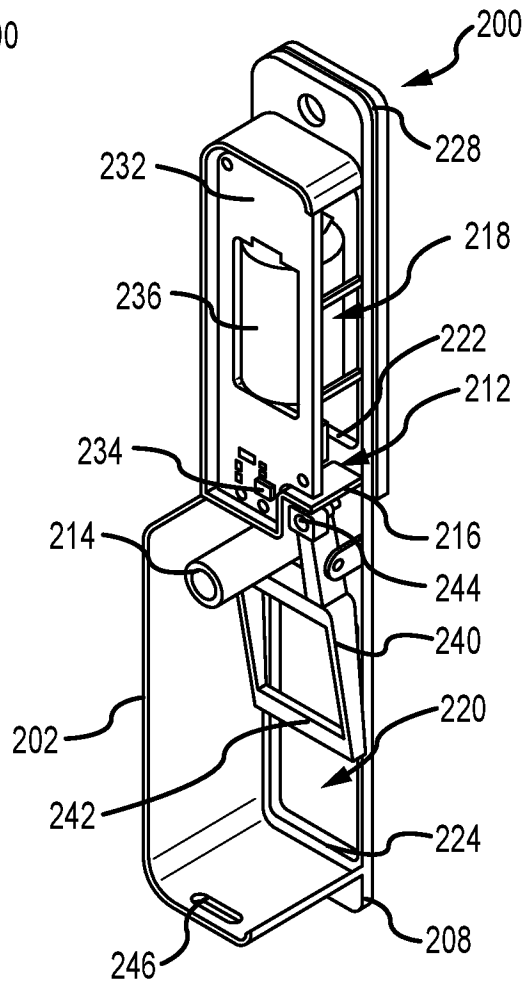
FIGS. 2A-2C are front, back, and partial interior perspective views of a swing door keeper sensor.
Figure 2B:
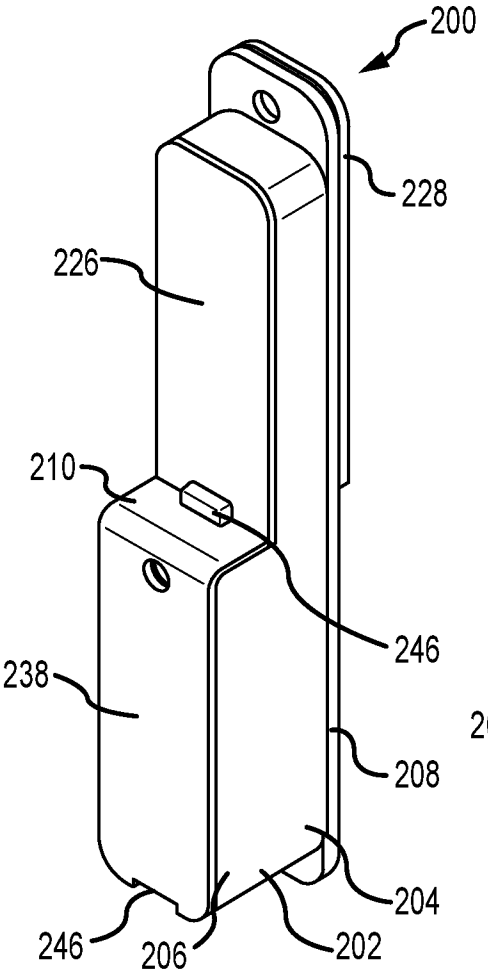
Figure 2A:
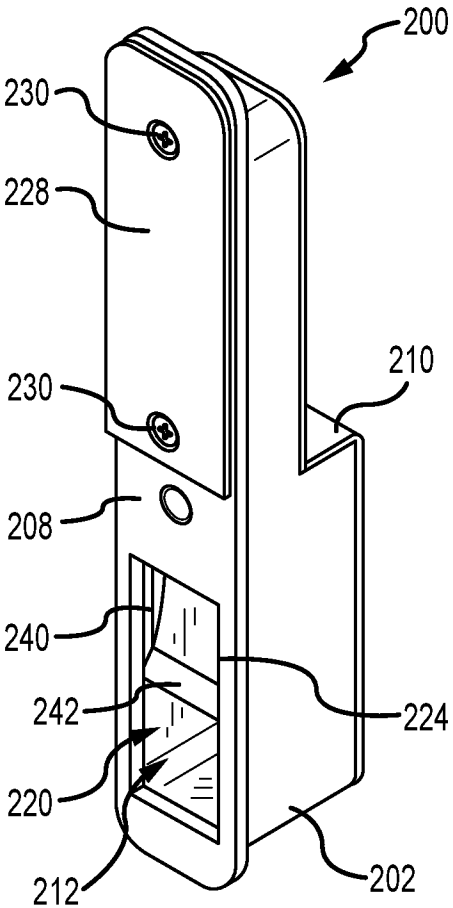

FIGS. 2A-2C are front, back, and partial interior perspective views of a swing door keeper sensor 200. Referring concurrently to FIGS. 2A-2C, the keeper sensor 200 is configured to receive a locking element (e.g., a deadbolt) from a swing door and send a signal in the door lock system as described above in FIG. 1. For example, the door keeper sensor 200 may be configured to send a signal and remotely actuate electronic remote lock systems. In the example, the keeper sensor 200 includes a housing 202 having a face end 204 and a back end 206. A face plate 208 is coupled to the housing 202 at the face end 204 and a back plate 210 is coupled to the housing 202 at the back end 206 and opposite the face plate 208. Thus, combined, the housing 202, face plate 208, and back plate 210 define an interior chamber 212 in which a number of other components are disposed. In some examples, one or more of the housing 202, the face plate 208, and/or the back plate 210 may be unitarily formed with the other(s).

A post 214 or other support strut may span the interior chamber 212 from the back plate 210 to the face plate 208 and may act as a guide for a screw or other fastener (not shown) to secure the face plate 208 and/or the back plate 210 to the housing 202. The housing 202 includes a wall 216 that extends from the face plate 208 to the back plate 210 and separates the interior chamber 212 into a battery chamber 218 and a discrete actuator chamber 220. As such, the battery chamber 218 can be completely sealed from the actuator chamber 220 and prevent the components within the battery chamber 218 from being exposed to corrosive conditions.

The face plate 208 defines a battery opening 222 adjacent to the battery chamber 218 that enables access into the battery chamber 218 and defines an actuator opening 224 adjacent to the actuator chamber 220 that enables access into the actuator chamber 220. The battery chamber 218 can be sealed by a first portion 226 of the back plate 210 and by a removable front cover 228 over the battery opening 222 attachable with one or more fasteners 230. A circuit board assembly 232 having a sensor 234 and a power source 236 (e.g., a battery) are disposed within the battery chamber 218 and are described further below in reference to FIG. 5.

The actuator chamber 220 is partially enclosed by a second portion 238 of the back plate 210 and is open at the actuator opening 224, which is configured to receive a locking element extending therethough. An actuator 240 having a strike 242 and a magnet 244 are completely disposed within the actuator chamber 220 and are described further below in reference to FIG. 4. The strike 242 is positioned proximate the actuator opening 224 and the magnet 244 is positioned proximate the sensor 234, but on the opposite side of the wall 216 that divides the battery chamber 218 and the actuator chamber 220.

In the example, the first portion 226 and the second portion 238 of the back plate may be separate components. As such, the first portion 226 may be ultrasonically welded to the back end 206 of the housing 202 and provide a seal to the battery chamber 218. The first portion 226 is described further below in FIGS. 16A and 16B. The second portion 238 may be a cover that can releasable coupled to the housing 202 and enclose the actuator chamber 220. For example, the second portion 238 may include one or more snap features 246 that can snap lock the cover to the housing 202 and/or the first portion 226. Other connection elements (e.g., threaded fasteners) may be used as required or desired. In other examples, the back plate 210 may be unitary and formed as a one-piece component that is either releaseably coupled to the housing 202 or ultrasonically welded thereto.

Figure 3A:
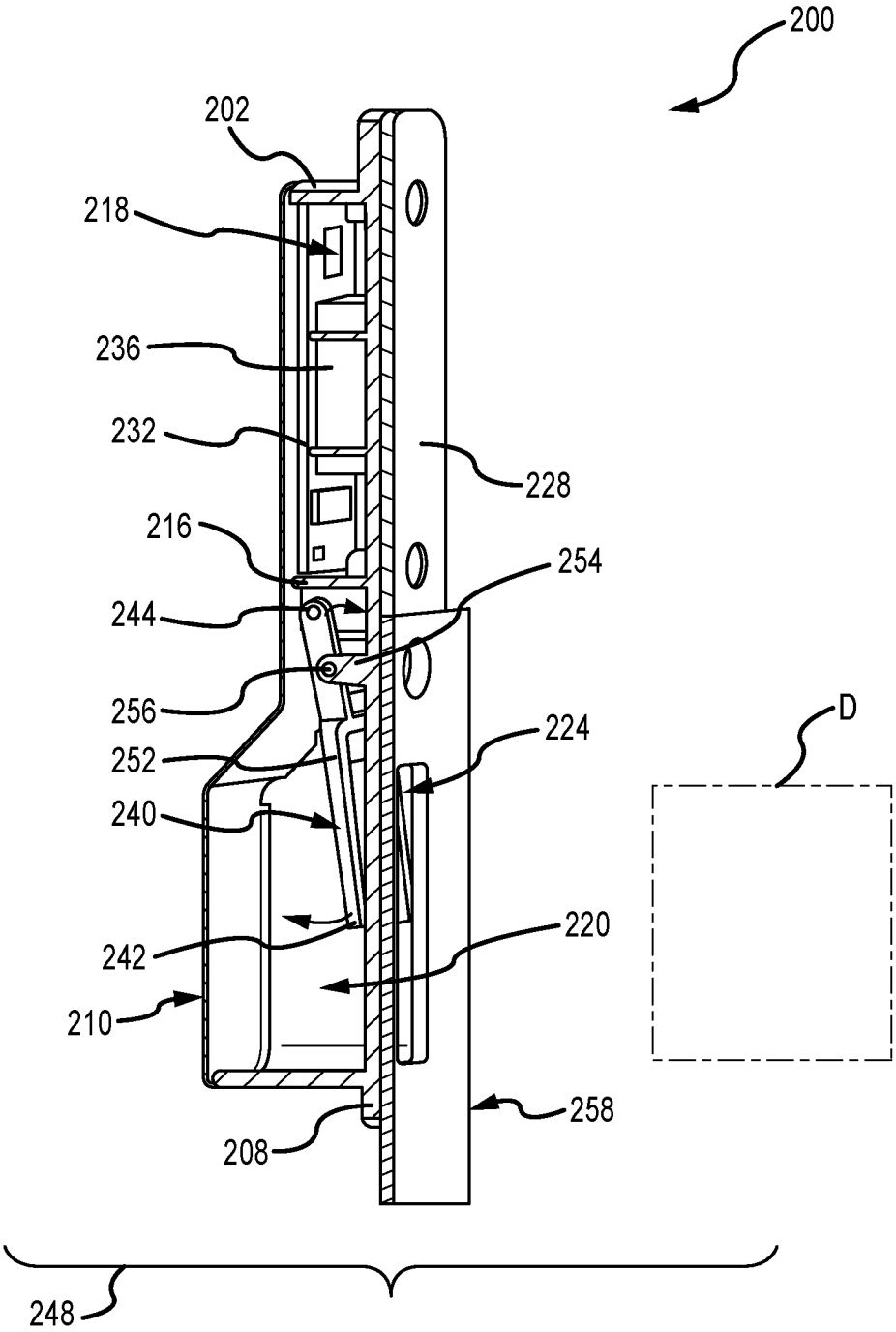
FIGS. 3A and 3B are interior perspective views of the swing door keeper sensor in a deactivated position and an activated position, respectively.
Figure 3B:
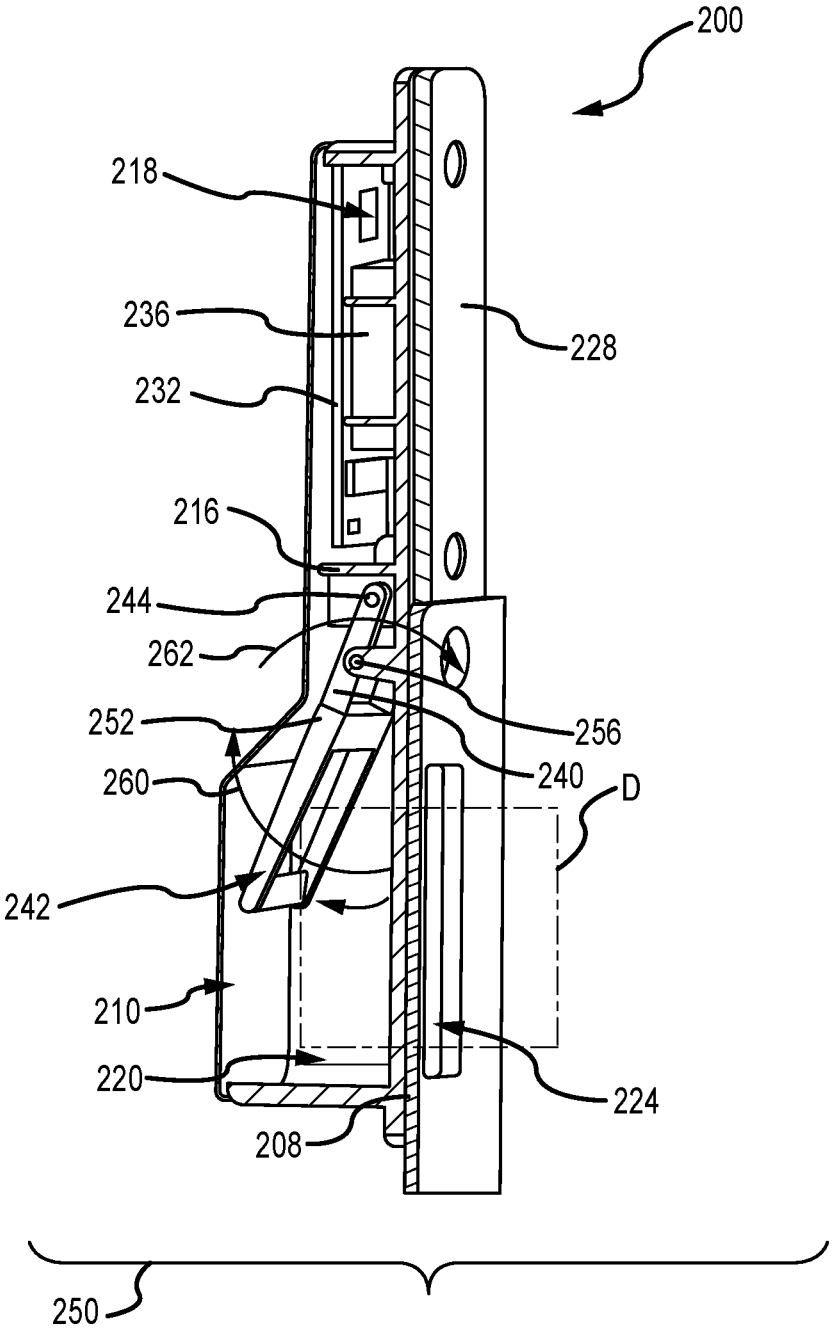

FIGS. 3A and 3B are interior perspective views of the swing door keeper sensor 200 in a deactivated position 248 and an activated position 250, respectively. Referring first to FIG. 3A, the keeper sensor 200 is in the deactivated position 248 and awaiting receipt of a locking element (e.g., a linearly extending and retracting deadbolt D) extended from either an electronic or manual locking system as described above. In this position, the keeper sensor 200 is mounted, for example, within a door frame and aligned with the deadbolt D. As such, the actuator opening 224 is configured to at least partially receive the deadbolt D so that it may contact the actuator 240. The actuator 240 is pivotally coupled within the actuator chamber 220 of the housing 202. In the example, that actuator 240 includes a lever arm 252 that is pivotably supported along the face plate 208 by one or more support posts 254 and pivot pins 256. The lever arm 252 supports the strike 242 on one end and the magnet 244 on an opposite end. The actuator 240 is biased in the deactivated position 248 so that the strike 242 is positioned adjacent to the face plate 208 and spans at least partially across the actuator opening 224. This positions the strike 242 so that the deadbolt D can contact the strike 242 as it is received within the actuator chamber 220.

Additionally, in the biased deactivated position 248, the magnet 244 is positioned proximate the wall 216, toward the back plate 210, and in a first position with respect to the sensor coupled to the circuit board assembly 232. When the magnet 244 is located in the first position, the sensor is deactivated thus indicating that there is no deadbolt D extended within the keeper sensor 200. The sensor can be powered by the power source 236 that is disposed within the battery chamber 218. In the example, a strike plate 258 may also be attached to the face plate 208 and surrounding the actuator opening 224.

Referring now to FIG. 3B, in operation, the locking element (e.g., the deadbolt D) can be extended from the lock system, entering the keeper sensor 200 through the actuator opening 224 and into the actuator chamber 220. The extending deadbolt D contacts the strike 242 of the actuator 240 and pivots 260 the strike 242 into the actuator chamber 220 and towards the back plate 210. As the strike 242 pivots 260, the magnet 244, via the lever arm 252, correspondingly pivots 262 in the same rotational direction about the pivot pins 256 and towards the face plate 208. Movement of the actuator 240 changes the keeper sensor 200 from the deactivated position 248 to the activated position 250. In the activated position 250, the magnet 244 changes its position relative to the sensor to a second position, which activates the sensor and electronic communication within the lock system as described above in reference to FIG. 1. The sensor, however, maintains it separation from the magnet 244, via the wall 216, so that the battery chamber 218 remains sealed with no components extending into the actuator chamber 220. The wall 216 may be formed from plastic so as to more easily enable the magnetic field of the magnet 244 to pass therethrough and activate the sensor.

Because the entire circuit board assembly 232, power source 236, and sensor are sealed within the battery chamber 218, for example, by the portion of the back plate 210 that is welded to the housing 202 and the front cover 228 that is sealed to the face plate 208, exposure to corrosive conditions is reduced. Thus, the life cycle of the components of the keeper sensor 200 are extended. Furthermore, once the deadbolt D is retracted out of the actuator chamber 220, the actuator 240 is biased to pivot back into its deactivated position 248 as illustrated in FIG. 3A. In the example, the keeper sensor 200 is described as being activated upon receipt of the deadbolt D and deactivated upon retraction of the deadbolt D. In other examples, the keeper sensor 200 may be activated upon retraction of the deadbolt D and deactivated upon receipt of the deadbolt D as required or desired.

Figure 4:
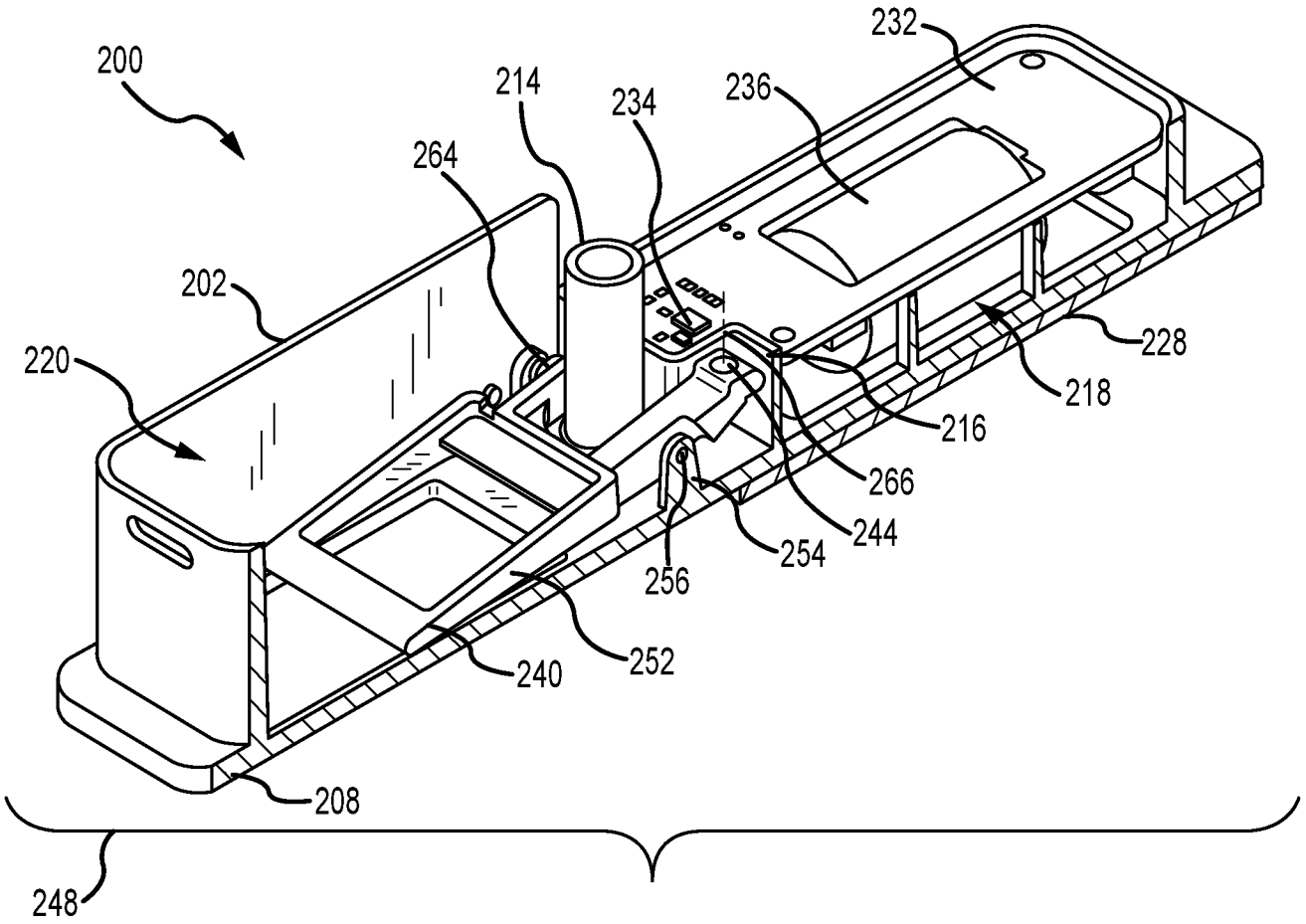
FIG. 4 is a cross-sectional interior perspective view of the swing door keeper sensor.

FIG. 4 is a cross-sectional interior perspective view of the swing door keeper sensor 200. Certain components are described above, and thus, are not necessarily described further below. As described above, the actuator 240 is pivotably supported within the actuator chamber 220 by one or more support posts 254 and pivot pins 256. The actuator 240 is biased into the deactivated position 248 by a torsion spring 264. In other examples, the actuator 240 may be biased by an extension spring, a compression spring, an elastomer element, or any other element that enables the actuator 240 to function as described herein. In the example, the lever arm 252 is split so that it is disposed around the post 214 with the magnet 244 on one side and the torsion spring 264 on the other. Additionally or alternatively, the torsion spring 264 may bias the magnet leg as required or desired.

The magnet 244 is disposed in, or on, the end of the lever arm 252 with a magnet axis 266 extending substantially perpendicular to the face plate 208 and/or the back plate (not shown). That is, the magnet axis 266 is substantially parallel to a depth of the wall 216 that extends between the face plate 208 and the back plate. By orienting the magnet 244 in this direction, the magnet field more easily engages with the sensor 234 to activate or deactivate depending on the position of the magnet 244. The sensor 234 is disposed within the battery chamber 218 and is positioned proximate the magnet 244 on the other side of the wall 216. As such, the sensor 234 can be sealed to reduce exposure to corrosive conditions. In the example, the sensor 234 may be a Hall Effect sensor, which operates as an electronic switch. In other examples, the sensor 234 the sensor can be any other magnetic-type sensors, such as a reed switch that enable the keeper sensor 200 to function as described herein.

Figure 5:
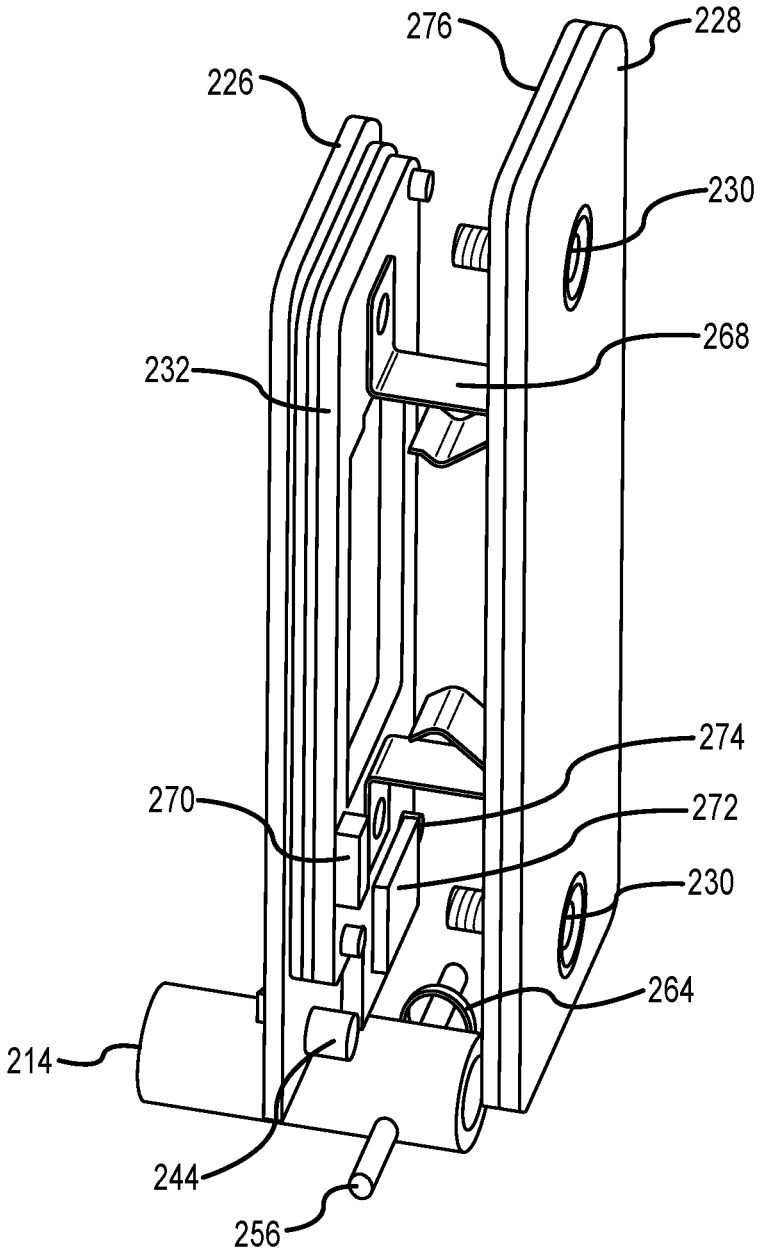
FIG. 5 is an enlarged perspective view of the battery chamber components of the swing door keeper sensor.

FIG. 5 is an enlarged perspective view of the battery chamber components of the swing door keeper sensor 200 (shown in FIGS. 2A-2C). The circuit board assembly 232 is positioned adjacent to and coupled to the first portion 226 of the back plate, which can be ultrasonically welded to the housing. The circuit board assembly 232 may include battery leads 268 so that a battery (not shown) can be electrically coupled to the circuit board assembly 232 and provide power. The circuit board assembly 232 also includes the sensor 234 (shown in FIG. 4) which is positioned adjacent to the magnet 244 that is disposed outside of the battery chamber. The circuit board assembly 232 may also include any other components that enable operation of the keeper sensor 200 as described herein. For example, a communication component 270 may facilitate communication within the lock system (e.g., through wireless protocols), a storage component 272 may facilitate memory storage, and a controller 274 may be included. Also depicted in FIG. 5, are the removable front cover 228, cover fasteners 230, and a cover gasket 276. The gasket 276 may be used with the front cover 228 to increase the sealing function of the cover 228 even though it is removable. Disposed outside of the battery chamber are the post 214, the torsion spring 264, and a pair of actuator pivot pins 256 that enable the actuator to pivot between the deactivated and activated positions illustrated in FIGS. 3A and 3B.

Figure 6C:
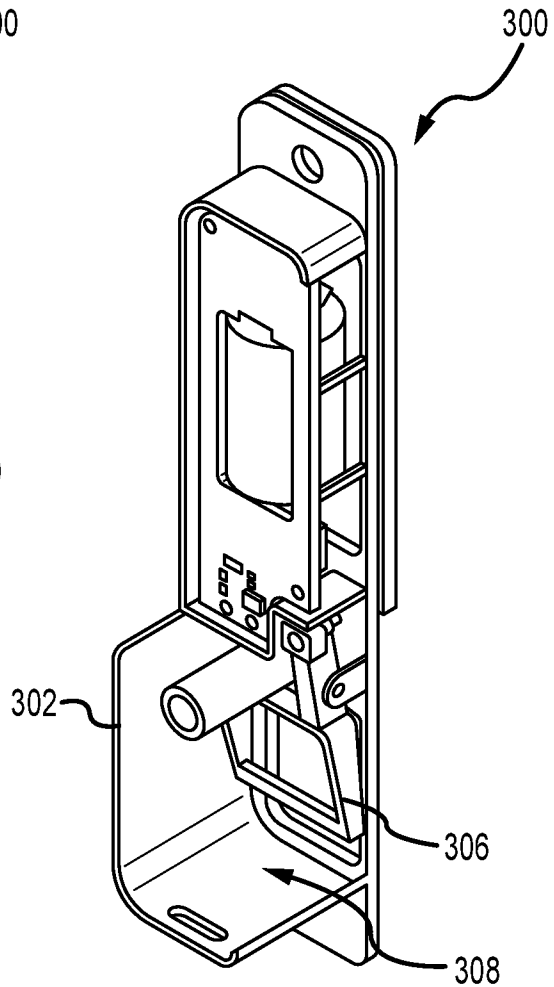
FIGS. 6A-6C are front, back, and partial interior perspective views of an entry door keeper sensor.
Figure 6B:
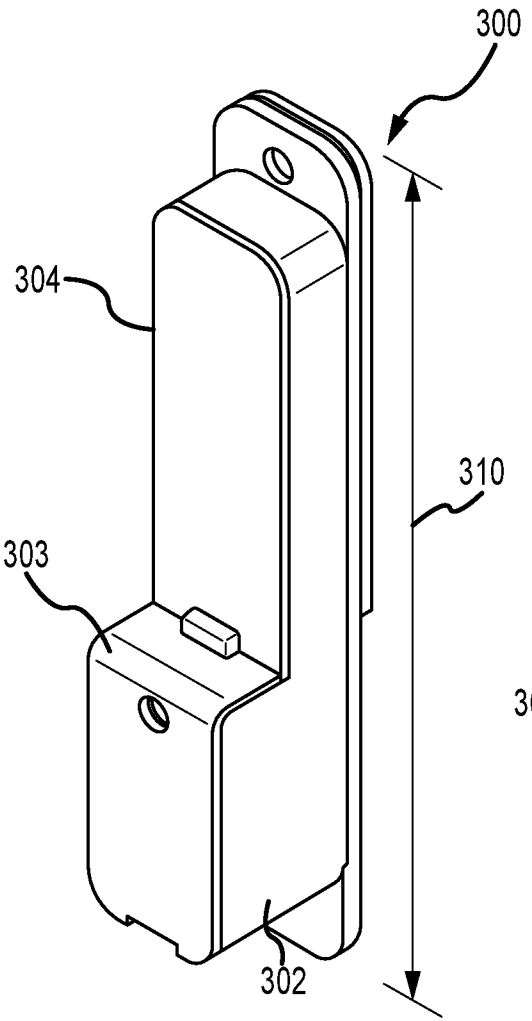
Figure 6A:
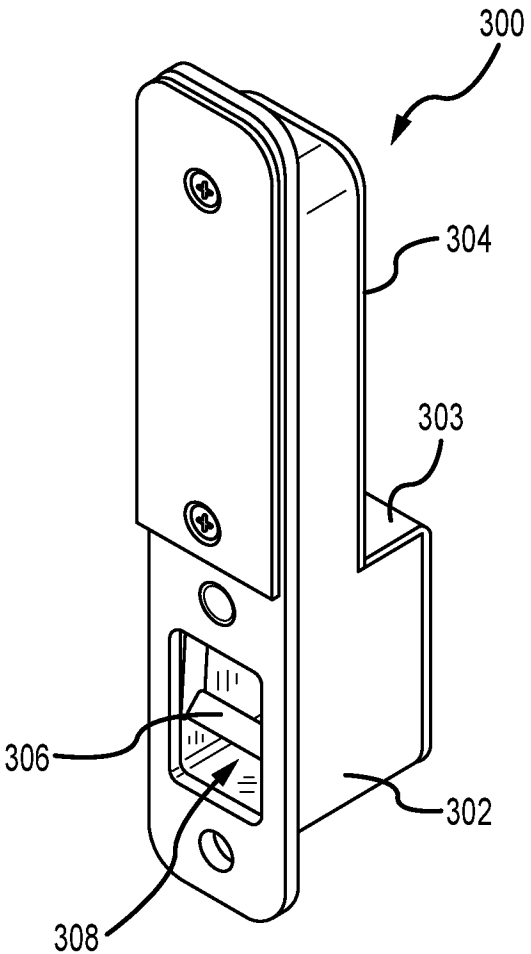

FIGS. 6A-6C are front, back, and partial interior perspective views of an entry door keeper sensor 300. The keeper sensor 300 contains similar components and is similarly functionally operable as the keeper sensor 200 that is described above in FIGS. 2A-5. However, entry doors may utilize locking elements (e.g., deadbolts) that are generally smaller in size than those used in swing doors; therefore, the keeper sensor 300 may utilize a generally smaller shape so as to be more easily mounted within a door frame and more securely receive the locking element. In order to enable the majority of the components to be used in both the entry door keeper sensor 200 and the swing door keeper sensor 300, and maintain manufacturing and assembly efficiencies, the keeper sensor 300 may only change the size and shape of a housing 302, a second portion 303 of the back plate 304, and an actuator 306. This enables an actuator chamber 308 to be smaller along a longitudinal axis 310 so as to more securely receive the locking element. Accordingly, only these three components are changed between the swing door keeper sensor 200 (shown in FIGS. 2A-2C) and the entry door keeper sensor 300 so that many of the components can be used in both designs. For example, all of the battery compartment components (e.g., circuit board assembly, power source, sensor, cover, etc.) are the same in both the swing door keeper sensor 200 and the entry door keeper sensor 300.

Figure 7:
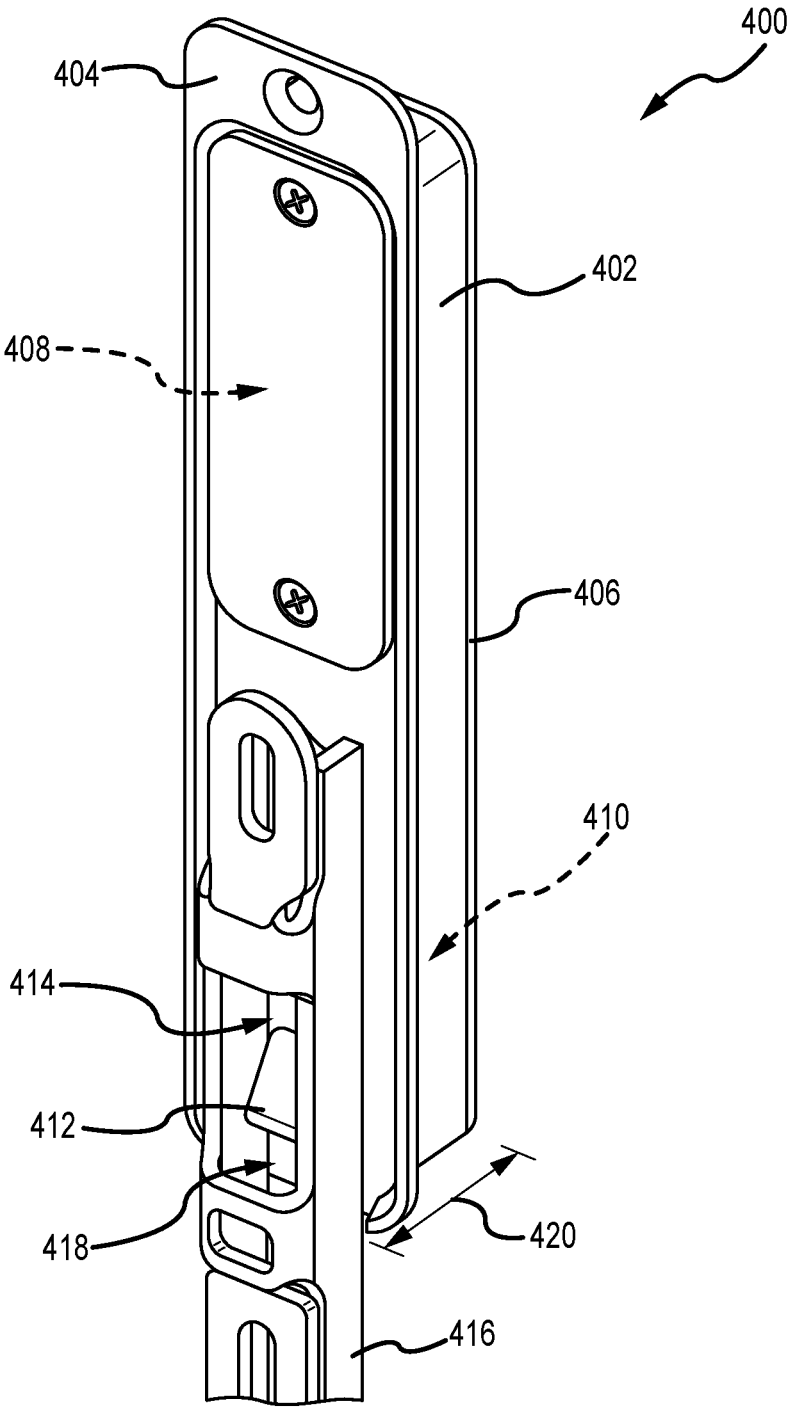
FIG. 7 is a perspective view of a sliding door keeper sensor.

FIG. 7 is a perspective view of a sliding door keeper sensor 400. Similar to the keeper sensors 200, 300 described above, the keeper sensor 400 includes a housing 402 with a face plate 404 and a back plate 406. As such, the housing 402 defines a battery chamber 408 that seals an electronic circuit board, a battery, a sensor, etc. therein, and an actuator chamber 410 that houses an actuator 412 therein. However, in this example, at least a portion of the actuator 412 extends from an actuator opening 414 defined in the face plate 404. A strike plate 416 is coupled to the face plate 404 opposite the housing 402 and proximate the actuator opening 414. The strike plate 416 at least partially defines a lock volume 418 that is configured to at least partially receive the locking elements of a sliding door, for example, a pair of opposing rhino-hooks (not shown).

At least a portion of the actuator 412 extends into the lock volume 418 so that it can be engaged by the locking elements and activate a sensor as described above. Because the locking elements of the sliding door lock rotate, rather than linearly slide like the swing and entry doors, the strike plate 416 extends from the face plate 404 so as to more easily receive the locking elements. A variety of locking element configurations may be used on the sliding door, for example, a one-point lock system (e.g., the 537 series lock sold by Amesbury Group, Inc.) as described in U.S. Pat. No. 9,885,200, the disclosure of which is hereby incorporated by reference herein in its entirety. In other examples, a multi-point lock system may also be used.

As such, the actuator 412 is configured to extend from the face plate 404 so that it may project within the lock volume 418 and more easily contact the locking elements. Since the actuator 412 extends from the face plate 404, the actuator chamber 410 may be sized to have a reduced depth 420 when compared to the keeper sensors 200, 300. Additionally, to accommodate different reaches of the locking elements (e.g., for difference sliding door and/or lock configurations), the actuator 412 can be modified to accommodate different projection lengths as described further below. By only changing the shape and size of the actuator 412, the number of unique components to be manufactured for the sliding door keeper sensor is reduced, and assembly efficiencies are increased because many of the components can be used in many different design configurations. For example, all of the battery compartment components (e.g., circuit board assembly, power source, sensor, cover, etc.), the housing 402, the face plate 404, and the back plate 406 can be the same for all of the sliding door keeper sensors described below.

In other examples, the sliding door keeper sensor 400 may have the face plate 404 forming the strike plate so that the rotating locking elements can rotate into the housing 402 and contact the actuator 412 housed therein (e.g., similar to the keeper sensors 200, 300 described above). In this example, the depth 420 of the housing 402 and the shape and size of the actuator 412 may be changed to accommodate different reaches of the locking elements as required or desired. The external strike plate may not be required in this example.

Figures 8A, 8B, 8C:
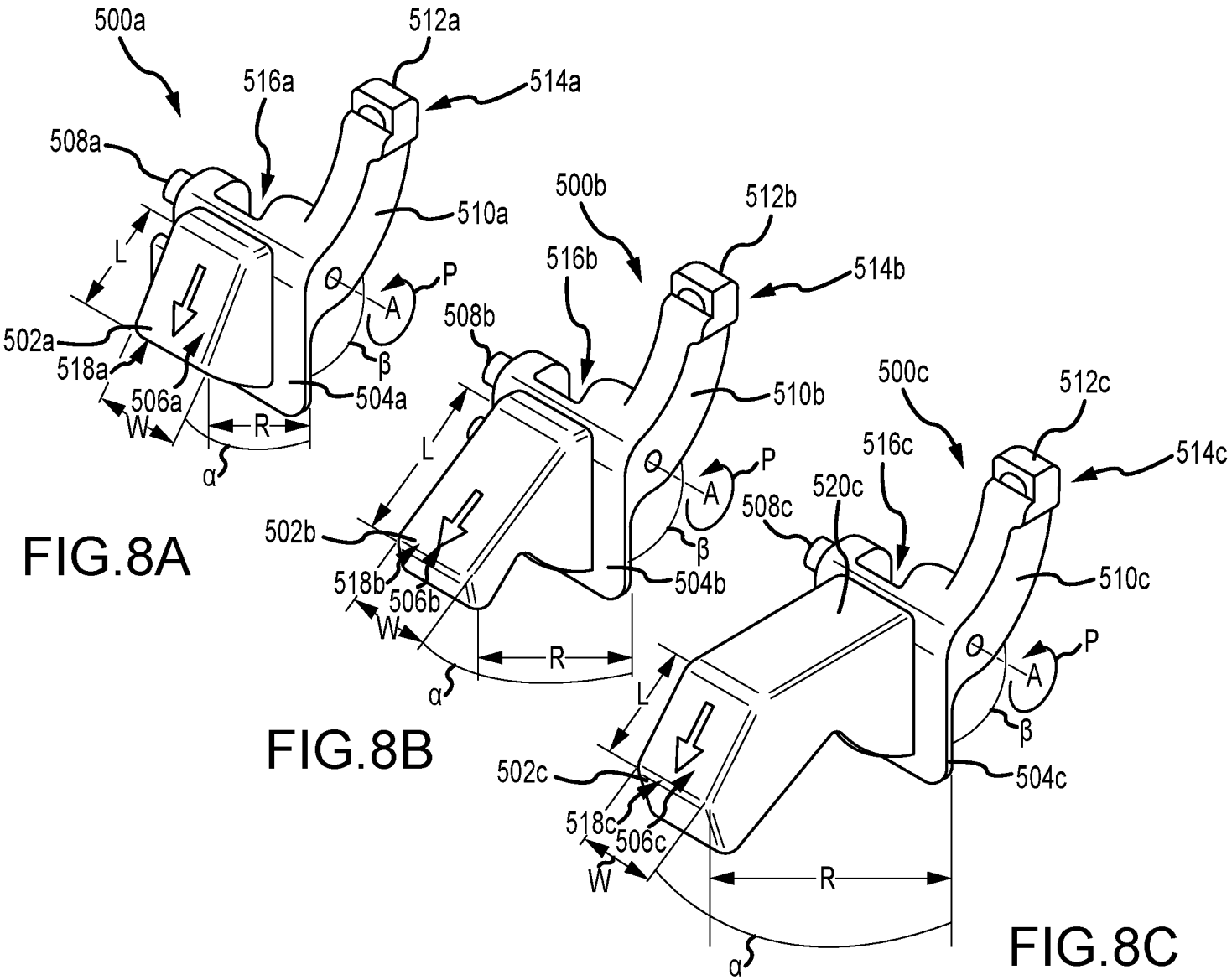
FIGS. 8A-8C are perspective views of exemplary actuators for use in the sliding door keeper sensor.

FIGS. 8A-8C are perspective views of exemplary actuators 500*a*-500*c* for use in the sliding door keeper sensor 400 (shown in FIG. 7). For example, the actuator 500*a* is depicted as actuator 412 (shown in FIG. 7) extending from the housing of the sliding door keeper sensor. In general, the actuators 500*a*-500*c* have certain shared structures, but of various sizes, as required for rotating locking elements having different sizes, depths, or other dimensions. Each actuator 500*a*-500*c* includes a strike 502*a* that is configured to project from the housing in which the actuator 500*a* is disposed. The strike 502*a* includes a face 506*a* that may be extended from and disposed at an angle α from a stop plate 504*a*. The stop plate 504*a* may prevent over-rotation of the actuator 500*a* about an axis A, as described in more detail below. For example, as depicted in FIGS. 8A-8C, the stop plate 504*a* is oversized, relative to at least one of the width W and length L of the face 506*a*. This larger size prevents the actuator 500*a* from overrotating, and thus, extending too far out of the opening in the sensor housing through which the strike 502*a* extends.

The actuator 500*a* includes an axle 508*a* aligned with the axis A, and which may be secured within a housing. An arm 510*a* extends from the axle 508*a* and includes a magnet 512*a* disposed on an end 514*a* thereof. The arm 510*a* may be disposed at an angle β to the stop plate 504*a*, as required or desired for a particular application. In general, internal housing clearances, internal void sizes and dimensions, location of the magnetic sensor, and other factors may be relevant to the angle β of the arm 510*a* from the stop plate 504*a*. Length of the arm 510*a* (e.g., from the axle 508*a* to the end 514*a* or magnet 512*a* may also be considered). In examples, a spring, such as a torsion spring (not shown), may be disposed in a recess 516*a* proximate the axle 508*a* so as to bias the actuator 500*a* in a position where the strike 502*a* extends from the housing. In other examples, the torsion spring may be disposed elsewhere, for example around the axle 508*a*.

In the depicted figures, one difference between the various actuators 500*a*-500*c* is a reach R of the strike 502*a*. In one example, the reach R is shown as the distance between the farthest edge 518*a* to the stop plate 504*a*. In the actuator of FIG. 8B, for example, the reach R of the strike 502*b* is increased by increasing the strike angle α over that depicted in FIG. 8A, as well as increasing the length L of the face 506*a*. In the actuator 500*c* of FIG. 8C, the reach R is increased by disposing the face 506*a* at an end of an elongate lever arm 520*c*, without necessarily increasing the length L of the face 506*a* (although in certain examples, the length L may also be increased). As such, the lever arm 520*c* extends between the stop plate 504*c* and the strike 502*c*. Additionally, in the depicted example, the strike angle α is not increased over that of the actuator 500*a* depicted in FIG. 8A, though adjustments of the strike angle α may also be made, as required or desired, for a particular application.

Furthermore, in the exemplary actuators 500*a*-500*c*, the angle β between the stop plates 504*a*-504*c* and the arms 510*a*-510*c* are substantially similar in each example. This enables, for the same size housing to be used for each actuator 500*a*-500*c* and increase assembly efficiencies. In other examples, any of the features of the actuators 500*a*-500*c* may be modified in a number of different ways as necessary to meet space, clearance, performance, and other requirements as required or desired.

In general, and as described in more detail below, the strike faces 506*a*-506*c* of each of the actuators 500*a*-500*c* depicted herein are configured so as to actuate when contacted by a locking element of an associated locking system, such as a hook. In the actuators 500*a*-500*c* depicted in FIGS. 8A-8C, the strike 502*a* is oriented at the angle α and an arrow on the strike face 506*a* points in a direction of travel of the associated lock point. That is, the arrow points generally downward, meaning the locking element approaches the strike face 506*c* from an downward direction, traveling downward until contact is made with the strike face 506*a*, thereby rotating the actuator 500*a* in a direction P about the axis A. This configuration and movement is described in more detail in FIGS. 9A-11B.

Figure 9B:
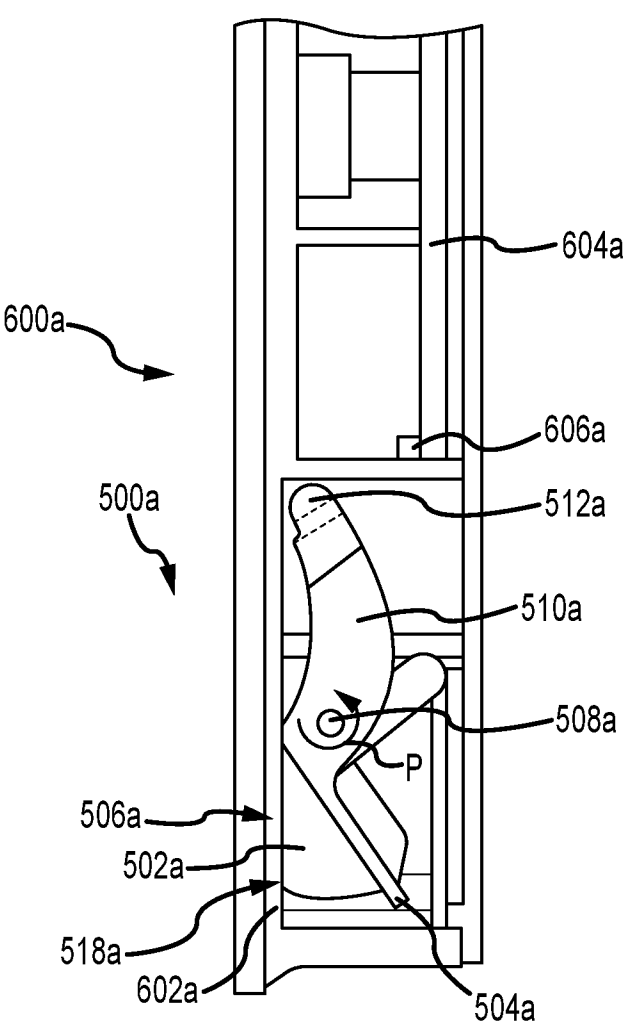
FIGS. 9A and 9B are side sectional views of a sliding door keeper sensor with the actuator in a first position and a second position, respectively.
Figure 9A:
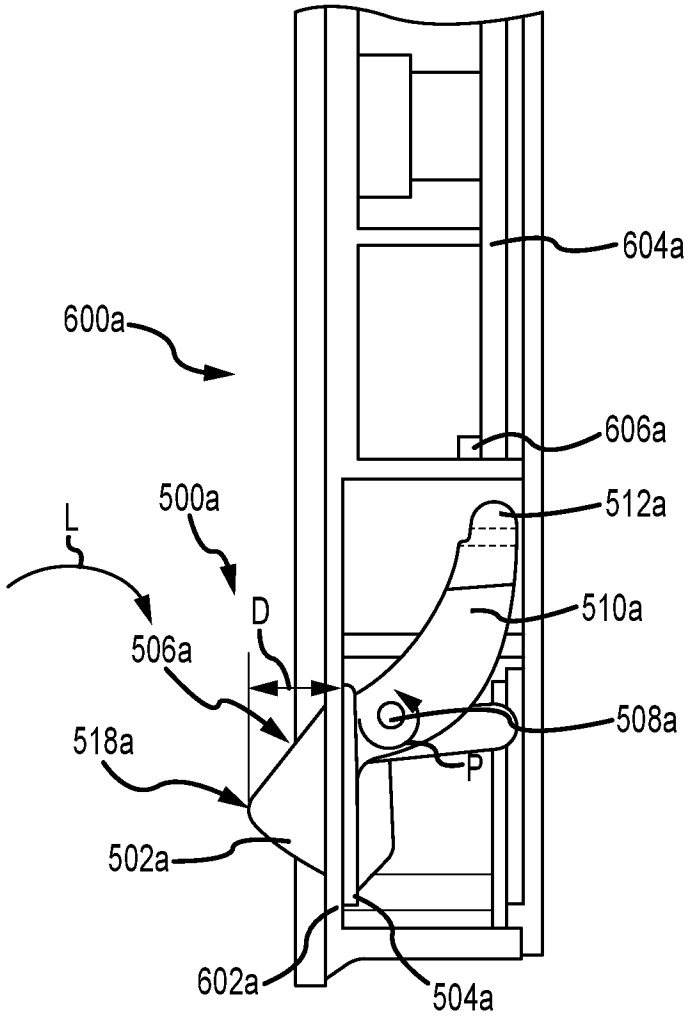

FIGS. 9A and 9B, described concurrently, are side sectional views of a sliding door keeper sensor 600*a* with the actuator 500*a* in a first position and a second position, respectively. In the example, the keeper sensor 600*a* may be similar to the example described in FIG. 7 and include an actuator chamber and a discrete and sealed battery chamber. In the first position, depicted in FIG. 9A, the stop plate 504*a* is biased to be in contact with a rear surface of a front face 602*a* of the keeper sensor 600*a* housing. In this position, the farthest edge 518*a* is disposed a distance D from the front face 602*a*, which is approximately equal to the reach distance R depicted in the above figures. This position enables the strike 502*a* to extend from the actuator chamber and into the lock volume as described in reference to FIG. 7 above.

In the first position, the magnet 512*a* is also disposed proximate the printed circuit board (PCB) 604*a* and a magnetic sensor 606*a* disposed thereon. However, the magnet 512*a* and sensor 606*a* are disposed in separate chambers. This position or presence of the magnet 512*a* relative to the sensor 606*a* may be detected when in the first position. A locking direction L of an associated lock element (not shown) is also depicted. In general, the locking element approaches the actuator 500*a* in a generally downward locking direction L. Once the locking element contacts the face 506*a*, the actuator 500*a* rotates P about the axle 508*a* until it reaches the second position depicted in FIG. 9B. In the example, the locking direction L is opposite of the actuator pivoting direction P. In this second position, the magnet 512*a* is no longer proximate the magnetic sensor 606*a* and is moved to a predetermined position away from the sensor 606*a* so that a change in the position of the magnet 512*a* can be detected. Additionally, the actuator 500*a* may be completely disposed within the actuator chamber of the keeper sensor 600*a*.

Figure 10B:
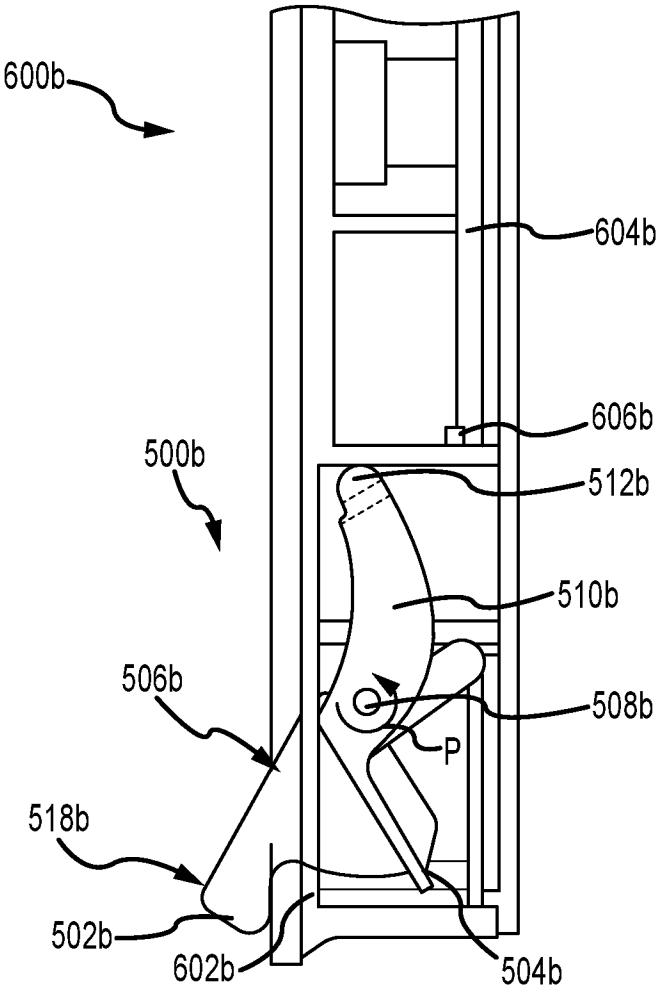
FIGS. 10A and 10B are side sectional views of a sliding door keeper sensor with the actuator in a first position and a second position, respectively.
Figure 10A:
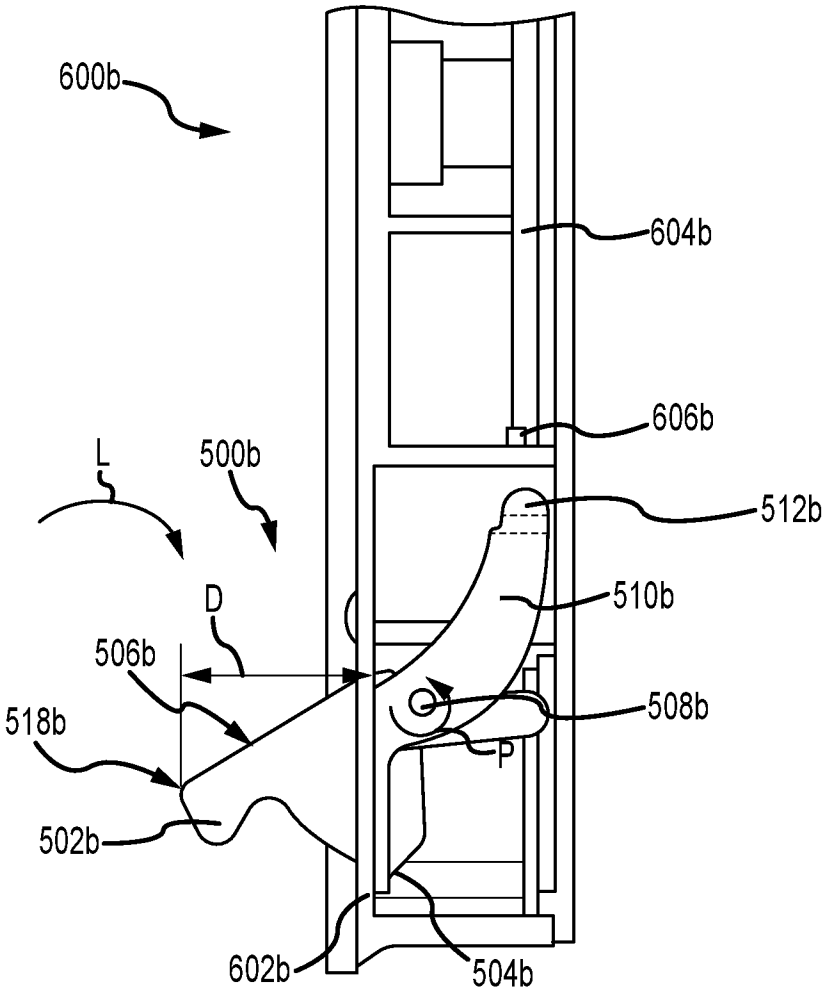

FIGS. 10A and 10B, described concurrently, are side sectional views of a sliding door keeper sensor 600*b* with the actuator 500*b* in a first position and a second position, respectively. In the first position, depicted in FIG. 10A, the stop plate 504*b* is in contact with a rear surface of a front face 602*b* of the keeper sensor 600*b* housing. In this position, the farthest edge 518*b* is disposed a distance D from the front face 602*b*, which is approximately equal to the reach distance R, depicted in the above figures. The magnet 512*b* is also disposed proximate the PCB 604*b* and a magnetic sensor 606*b* disposed thereon. Thus, the position or presence of the magnet 512*b* may be detected when in the first position. A locking direction L of an associated lock element (not shown) is also depicted. In general, the locking element approaches the actuator 500*b* in a generally downward locking direction L. Once the locking element contacts the face 506*b*, the actuator 500*b* rotates P about the axle 508*b* until it reaches the second position depicted in FIG. 10B. In this second position, the magnet 512*b* is no longer proximate the magnetic sensor 606*b*.

In this example, the strike 502*b* of the actuator 500*b* extends a greater distance D than the example above in FIGS. 9A and 9B. This enables for a different locking element to be used with same keeper sensor 600*b* housing. In the second position, the actuator 500*b* is not completely disposed within the actuator chamber of the keeper sensor 600*b*, but the magnetic sensor 606*b* is still moved to a predetermined position away from the sensor 606*b* so that a change in the position of the magnet 512*b* can be detected.

Figure 11B:
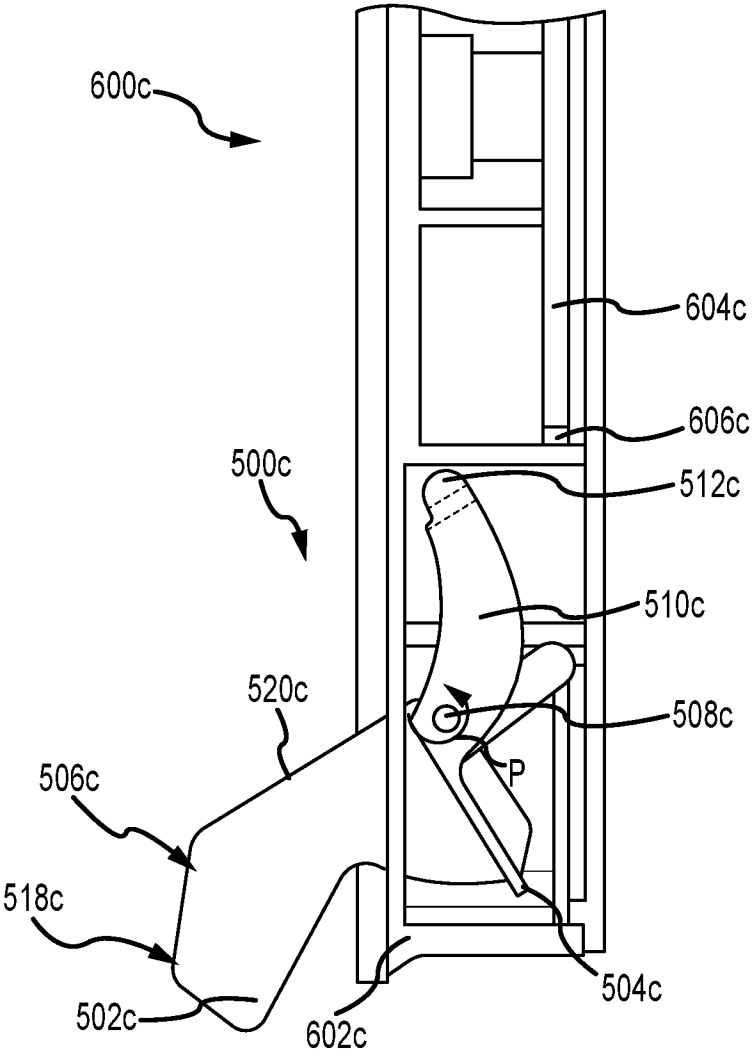
FIGS. 11A and 11B are side sectional views of a sliding door keeper sensor with the actuator in a first position and a second position, respectively.
Figure 11A:
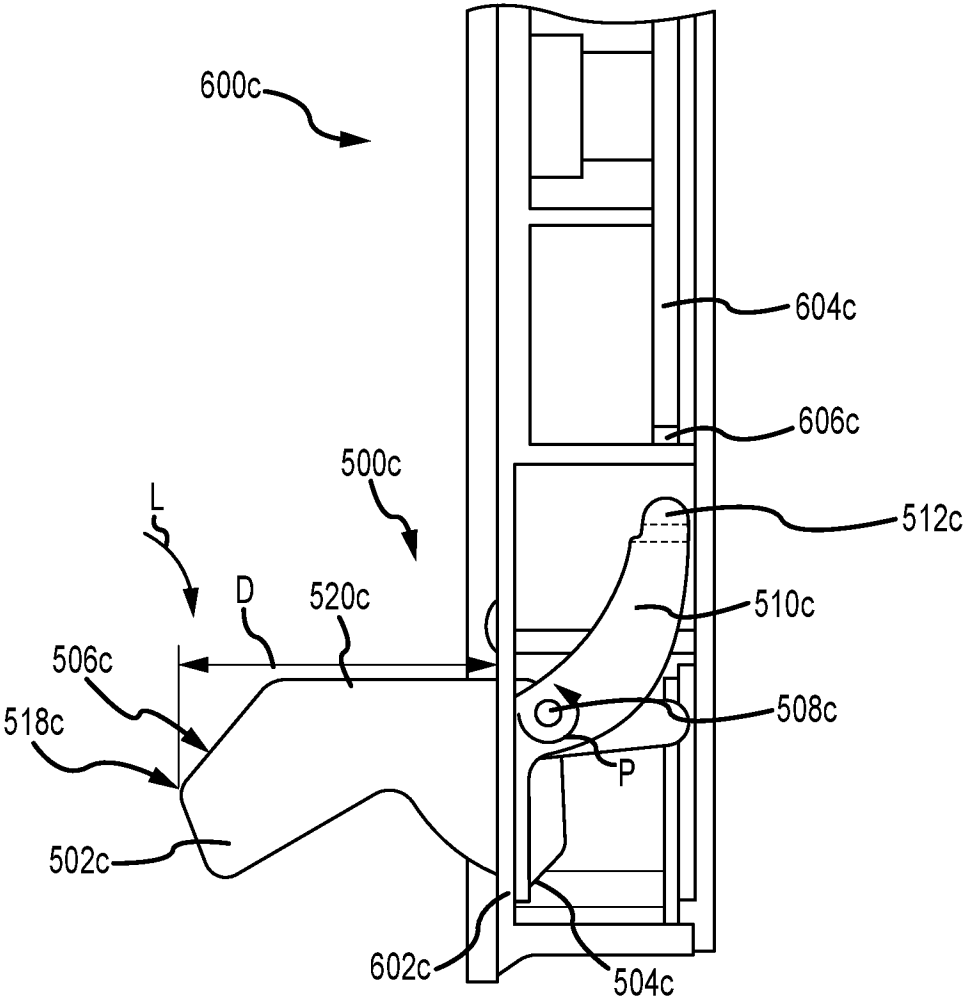

FIGS. 11A and 11B, described concurrently, are side sectional views of a sliding door keeper sensor 600*c* with the actuator 500*c* in a first position and a second position, respectively. In the first position, depicted in FIG. 11A, the stop plate 504*c* is in contact with a rear surface of a front face 602*c* of the keeper sensor 600*c* housing. In this position, the farthest edge 518*c* is disposed a distance D from the front face 602*c*, which is approximately equal to the reach distance R, depicted in the above figures. The magnet 512*c* is also disposed proximate the PCB 604*c* and a magnetic sensor 606*c* disposed thereon. Thus, the position or presence of the magnet 512*c* may be detected when in the first position. A locking direction L of an associated lock element (not shown) is also depicted. In general, the locking element approaches the actuator 500*c* in a generally downward locking direction L. Once the locking element contacts the face 506*c*, the actuator 500*c* rotates P about the axle 508*c* until it reaches the second position depicted in FIG. 11B. In this second position, the magnet 512*c* is no longer proximate the magnetic sensor 606*c*.

In this example, the strike 502*c* of the actuator 500*c* extends a greater distance D than the example above in FIGS. 9-10B. This enables for a different locking element to be used with same keeper sensor 600*c* housing. In the second position, the actuator 500*c* is not completely disposed within the actuator chamber of the keeper sensor 600*c*, but the magnetic sensor 606*c* is still moved to a predetermined position away from the sensor 606*c* so that a change in the position of the magnet 512*c* can be detected.

Figures 12A, 12B, 12C:
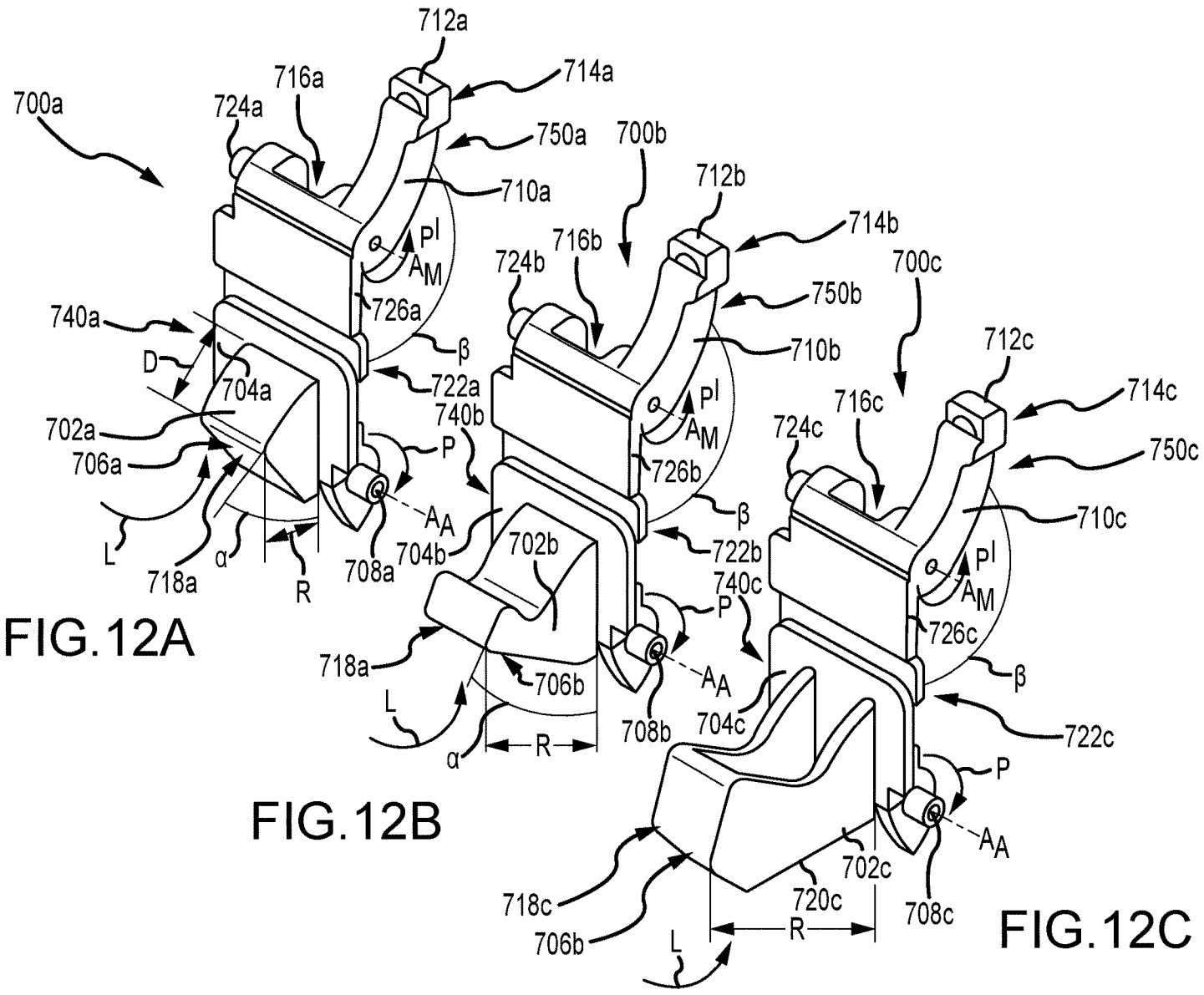
FIGS. 12A-12C are perspective views of additional exemplary actuators for use in the sliding door keeper sensor.

FIGS. 12A-12C are perspective views of additional exemplary actuators 700*a*-700*c* for use in the sliding door keeper sensor 400 (shown in FIG. 7). In general, the actuators 700*a*-700*c* have certain shared structures, but of various sizes, as required for keepers having different sizes, depths, or other dimensions. Each actuator 700*a*-700*c* includes two components, referred to herein generally as an actuator part 740*a* and a magnet part 750*a*. The actuator part 740*a* includes a strike 702*a* that is configured to project from the housing in which the actuator 700*a* is disposed. The strike 702*a* includes a face 706*a* that may be disposed at an angle α from a stop plate 704*a*. The stop plate 704*a* may prevent over-rotation of the actuator 700*a* about an axis A, as described in more detail below, as well as engage with the magnet part 750*a* at an interface 722*a*. For example, as depicted in FIGS. 12A-12C, the stop plate 704*a* is oversized, relative to at least one of the width and length of the face 706*a*. This larger size prevents the actuator 700*a* from overrotating and thus extending too far out of the opening in the sensor housing through which the strike 702*a* extends. Additionally, the larger size allows for engagement with the magnet part 750*a*, during the rotations described below. The actuator part 740*a* includes an axle 708*a* aligned with the actuator part axis $A_A$, and which may be secured within a sensor housing.

The magnet part 750*a* includes an arm 710*a* that extends from a magnet part axle 724*a* and includes a magnet 712*a* disposed on an end 714*a* thereof. The magnet part axle 724*a* defines a magnet part axis $A_M$. The arm 710*a* may be disposed at an angle β to an interface plate 726*a*, as required or desired for a particular application. In general, internal housing clearances, internal void sizes and dimensions, location of the magnetic sensor, and other factors may be relevant to the angle β of the arm 710*a* from the interface plate 726*a*. Length of the arm 710*a* (e.g., from the magnet part axle 724*a* to the end 714*a* or magnet 712*a* may also be considered). In examples, a spring, such as a torsion spring (not shown), may be disposed in a recess 716*a* proximate the magnet part axle 724*a* so as to bias the actuator 700*a* in a position where the strike 702*a* extends from the housing. Because the magnet part 750*a* is biased, the actuator part 740*a* does not necessary need to be individually biased since movement of the actuator part 740*a* can be induced by the locking element or the magnet part 750*a*. In other examples, the torsion spring may be disposed elsewhere, for example around the axle 708*a*. In still further examples, both the actuator part 740*a* and the magnet part 750*a* can be individually biased.

In the exemplary actuators 700*a*-700*c*, the angle β between the stop plates 704*a*-704*c* and the arms 710*a*-710*c* are substantially similar in each example. Additionally, the magnet part 750*a* may be the exact same in each example, with only the size and shape of the actuator part 740*a* changing. This enables, for the same size housing and magnet part 750*a* to be used for each actuator 700*a*-700*c* and increase assembly efficiencies. In other examples, any of the features of the actuators 700*a*-700*c* may be modified in a number of different ways as necessary to meet space, clearance, performance, and other requirements as required or desired.

In the depicted figures, one difference between the various actuators 700*a*-700*c* is the reach of the strike 702*a*. In one example, the reach R is shown as the distance between the farthest edge 718*a* to the stop plate 704*a*. In the actuator of FIG. 12B, for example, reach of the strike 702*b* is increased by increasing the strike angle α over that depicted in FIG. 12A, as well as increasing the length of the face 706*b*. In the actuator 700*c* of FIG. 12C, the reach R is increased by disposing the face 706*c* at an end of an elongate lever arm 720*c*, without necessarily increasing the length L of the face 706*c* (although in certain examples, the length L may also be increased). Additionally, in the depicted example, the strike angle α is not increased over that of the actuator 700*a* depicted in FIG. 12A, though adjustments of the strike angle α may also be made, as required or desired, for a particular application.

In general, and as described in more detail below, the strike faces 706*a*-706*c* of each of the actuators 700*a*-700*c* depicted herein are configured so as to actuate when contacted by a locking element L of an associated locking system, such as a hook. In the actuators 700*a*-700*c* depicted in FIGS. 12A-12C, rotation P of the actuator part 740*a* is in the opposite direction than the actuators depicted in FIGS. 8A-11B. That is, the locking element approaches the strike face 706*c* from an upward direction, traveling upward until contact is made with the strike face 706*a*, thereby rotating the actuator 700*a* in a direction P about the actuator part axis $A_A$. Contact at the interface 722*a* causes a corresponding rotation P' of the magnet part 750*a*, thus moving the magnet 712*a*. This configuration and movement is described in more detail in FIGS. 13A-15B.

Figure 13B:
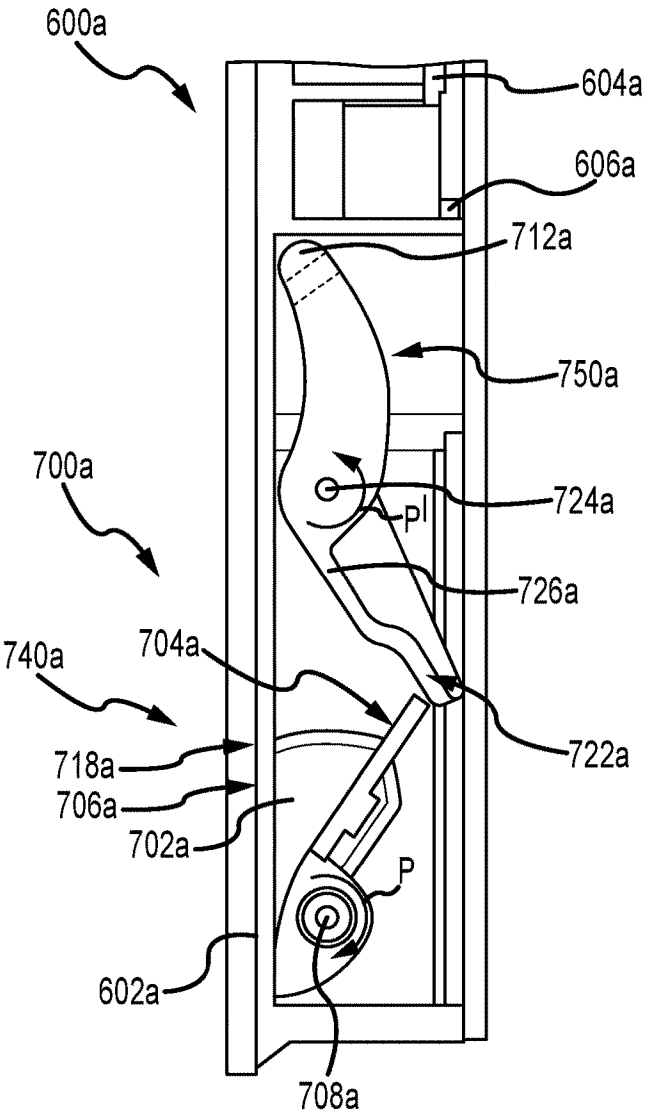
FIGS. 13A and 13B are side sectional views of a sliding door keeper sensor with the actuator in a first position and a second position, respectively.
Figure 13A:
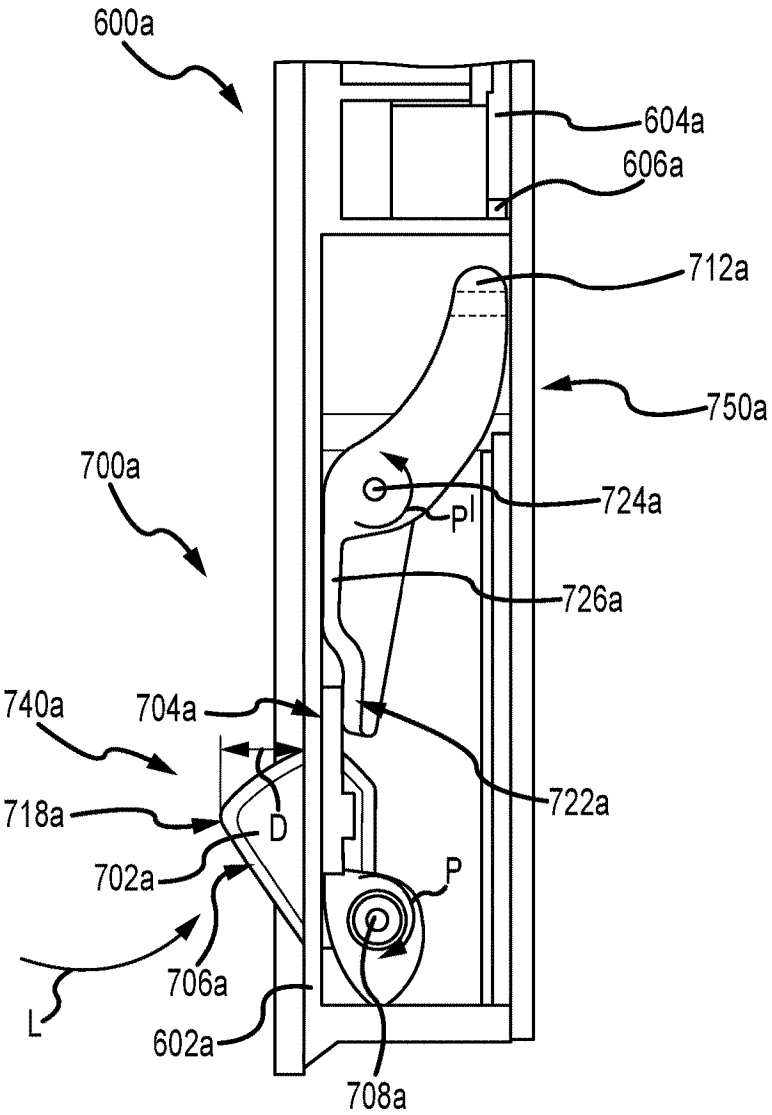

FIGS. 13A and 13B, described concurrently, are side sectional views of a sliding door keeper sensor 600*a* with the actuator 700*a* in a first position and a second position, respectively. In the first position, depicted in FIG. 13A, the stop plate 704*a* is in contact with a rear surface of a front face 602*a* of the keeper sensor 600*a* housing. In this position, the farthest edge 718*a* is disposed a distance D from the front face 602*a*, which is approximately equal to the reach distance R, depicted in the above figures. The magnet 712*a* is also disposed proximate the PCB 604*a* and a magnetic sensor 606*a* disposed thereon. Thus, the position or presence of the magnet 712*a* may be detected when in the first position. A locking direction L of an associated lock element (not shown) is also depicted. In general, the locking element approaches the actuator 700*a* in a generally upward locking direction L. Once the locking element contacts the face 706*a*, the actuator part 740*a* rotates P about the axle 708*a* until it reaches the second position depicted in FIG.

13B. In this second position, the rotation of actuator part 740*a* causes a corresponding, but opposite, rotation P' of the magnet part 750*a*, such that the magnet 712*a* is no longer proximate the magnetic sensor 606*a*.

Figure 14B:
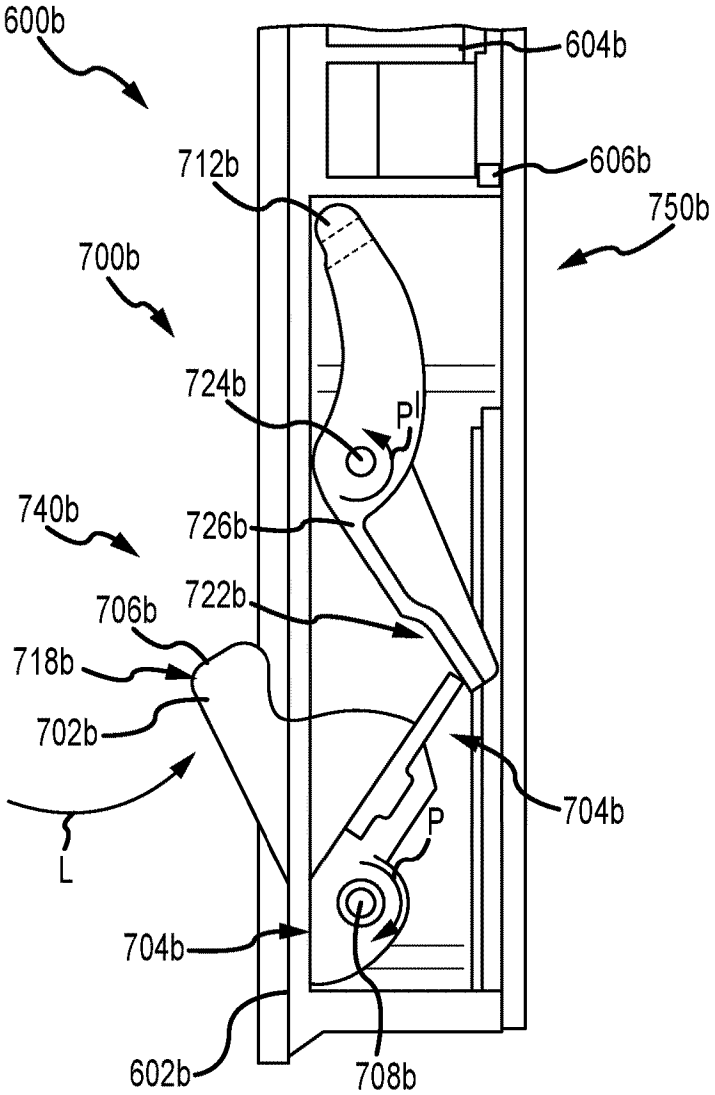
FIGS. 14A and 14B are side sectional views of a sliding door keeper sensor with the actuator in a first position and a second position, respectively.
Figure 14A:
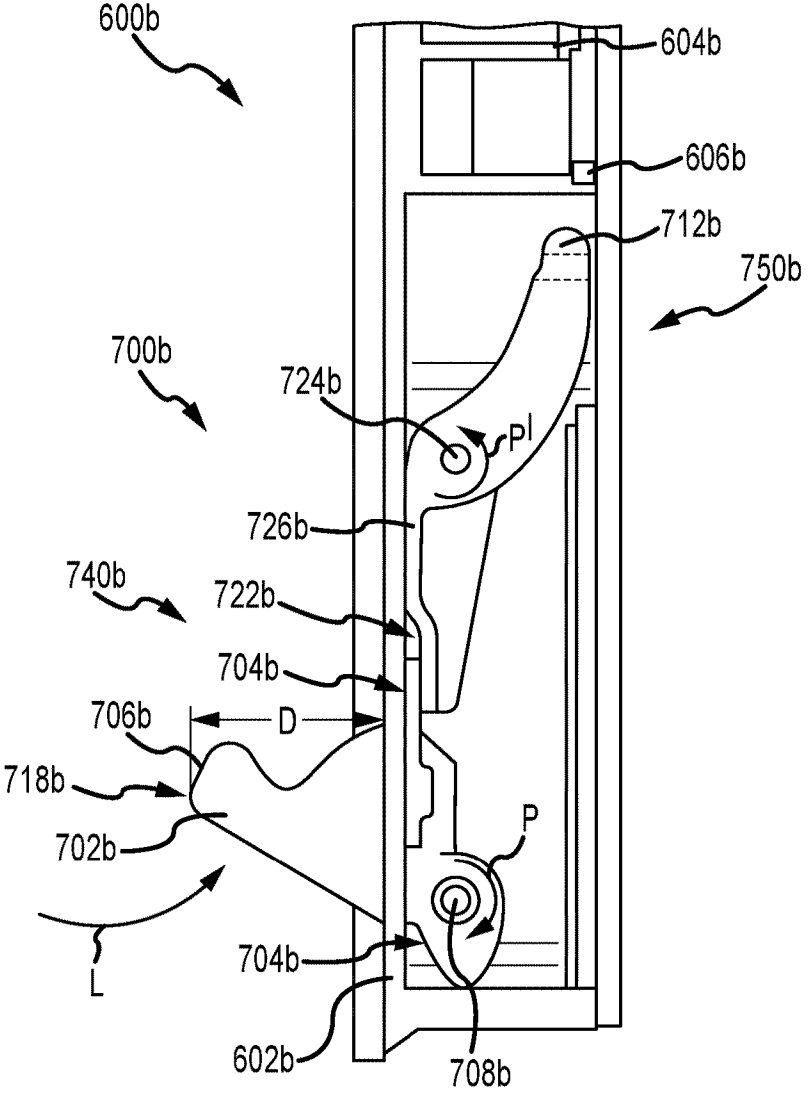

FIGS. 14A and 14B, described concurrently, are side sectional views of a sliding door keeper sensor 600*b* with the actuator 700*b* in a first position and a second position, respectively. In the first position, depicted in FIG. 14A, the stop plate 704*b* is in contact with a rear surface of a front face 602*b* of the keeper sensor 600*b* housing. In this position, the farthest edge 718*b* is disposed a distance D from the strike face 706*b*, which is approximately equal to the reach distance R, depicted in the above figures. The magnet 712*b* is also disposed proximate the PCB 604*b* and a magnetic sensor 606*b* disposed thereon. Thus, the position or presence of the magnet 712*b* may be detected when in the first position. A locking direction L of an associated lock element (not shown) is also depicted. In general, the locking element approaches the actuator 700*b* in a generally upward locking direction L. Once the locking element contacts the face 706*b*, the actuator part 740*b* rotates P about the axle 708*b* until it reaches the second position depicted in FIG. 14B. In this second position, the rotation of actuator part 740*b* causes a corresponding, but opposite, rotation P' of the magnet part 750*b*, such that the magnet 712*b* is no longer proximate the magnetic sensor 606*b*.

Figure 15B:
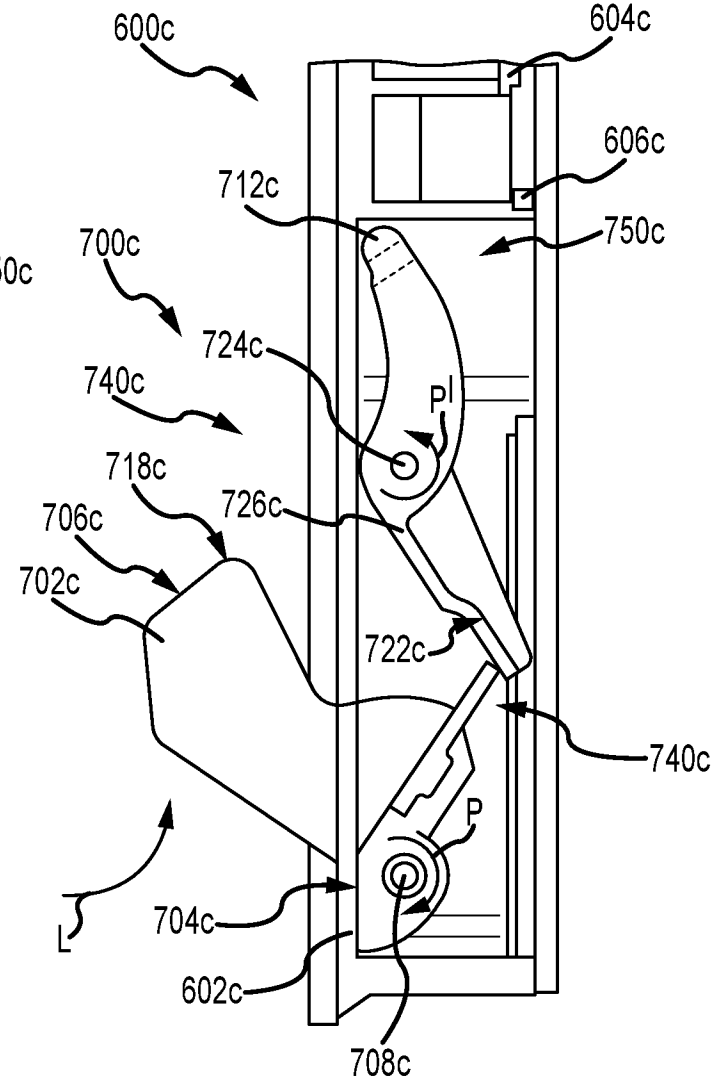
FIGS. 15A and 15B are side sectional views of a sliding door keeper sensor with the actuator in a first position and a second position, respectively.
Figure 15A:
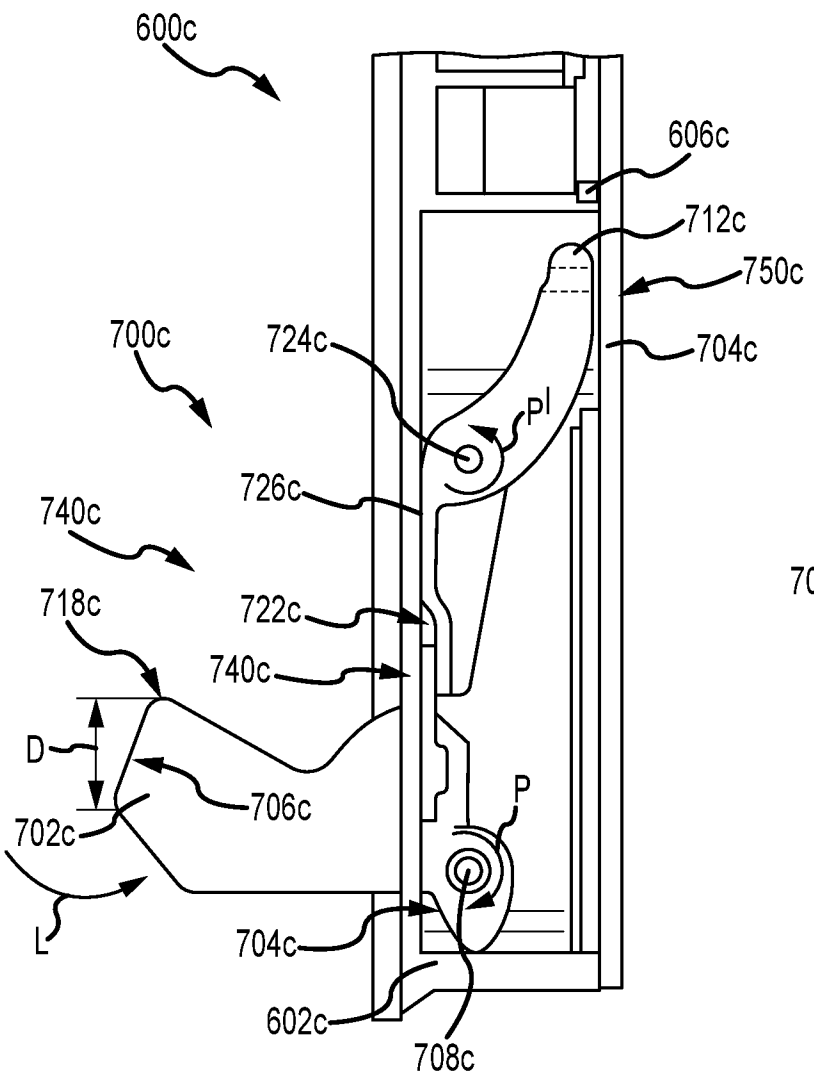

FIGS. 15A and 15B, described concurrently, are side sectional views of a sliding door keeper sensor 600*c* with the actuator 700*c* in a first position and a second position, respectively. In the first position, depicted in FIG. 15A, the stop plate 704*c* is in contact with a rear surface of a front face 602*c* of the keeper sensor 600*c* housing. In this position, the farthest edge 718*c* is disposed a distance D from the front face 602*c*, which is approximately equal to the reach distance R, depicted in the above figures. The magnet 712*c* is also disposed proximate the PCB 604*c* and a magnetic sensor 606*c* disposed thereon. Thus, the position or presence of the magnet 712*c* may be detected when in the first position. A locking direction L of an associated lock element (not shown) is also depicted. In general, the locking element approaches the actuator 700*c* in a generally upward locking direction L. Once the locking element contacts the face 706*c*, the actuator part 740*c* rotates P about the axle 708*c* until it reaches the second position depicted in FIG. 15B. In this second position, the rotation of actuator part 740*c* causes a corresponding, but opposite, rotation P' of the magnet part 750*c*, such that the magnet 712*c* is no longer proximate the magnetic sensor 606*c*.

Figure 16B:
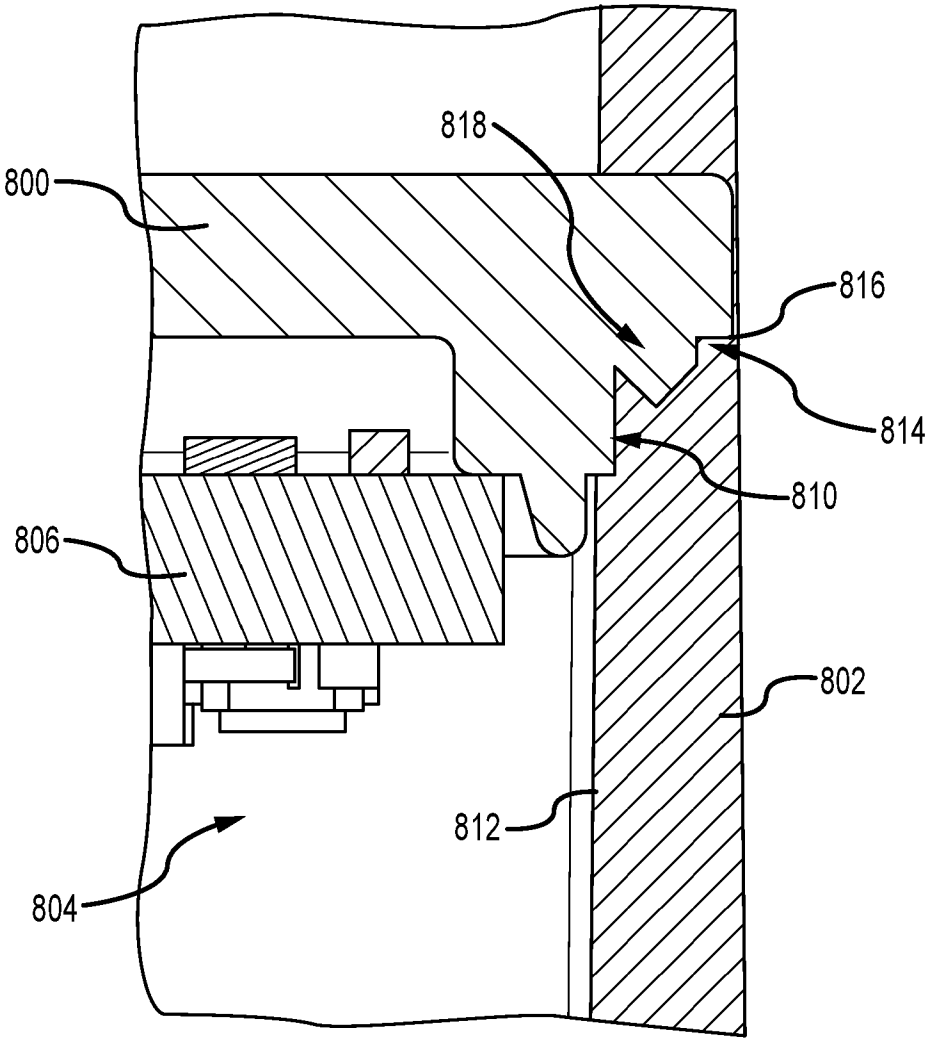
FIG. 16B is a cross-sectional view of the back plate coupled to a housing.
Figure 16A:
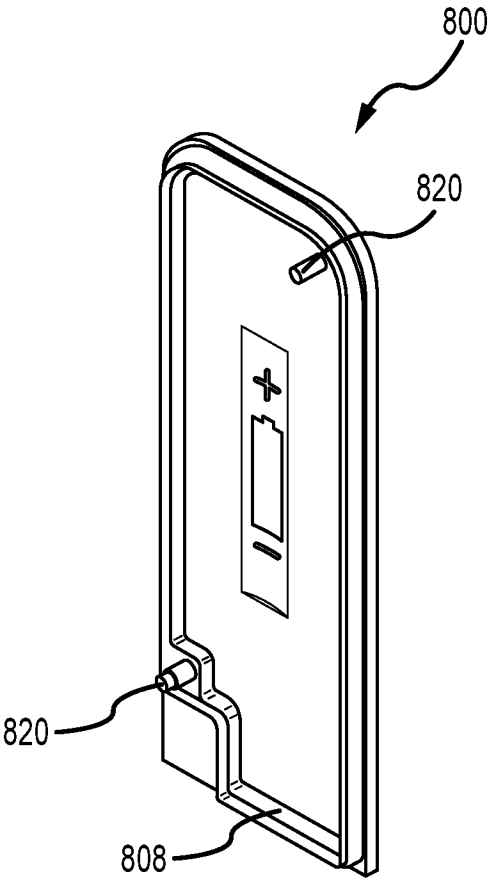
FIG. 16A is a perspective view of an exemplary back plate.

FIG. 16A is a perspective view of an exemplary back plate 800. FIG. 16B is a cross-sectional view of the back plate 800 coupled to a housing 802. Referring concurrently to FIGS. 16A and 16B and as described above, at least a portion of the back plate 800 may be ultrasonically welded onto the housing 802 so as to increase the seal of the battery chamber 804 and prevent exposure of the components therein (e.g., the PCB 806) to corrosive conditions. In the example, the back plate 800 includes a perimeter ridge 808 that is positioned adjacent to the housing 802 and provides additional melt material to the weld joint between the back plate 800 and the housing 802. This added material increases the strength of the weld seam, and also, improves the sealing capability of the weld seam. In the example, the ridge 808 includes a shear joint zone 810 that is positioned adjacent to a sidewall 812 of the housing 802 and a butt joint zone 814 that is positioned adjacent to an end wall 816 of the housing. At the intersection of the butt joint zone 814 and the shear joint zone 810, the ridge 808 includes an extension 818 of additional material beyond what is normally suggested in ultrasonic welding design. This material extension 818 enables a larger melt zone to be formed by the welding process and fill the voids in the weld seam. The extension 818 may be any shape as required or desired to provide additional material into the melt zone. Additionally, the PCB 806 can be at least partially supported by the back plate 800 through one or more support members 820.

The materials utilized in the manufacture of the keepers described herein may be those typically utilized for lock manufacture, e.g., zinc, steel, aluminum, brass, stainless steel, etc. Molded plastics, such as PVC, polyethylene, etc., may be utilized for the various components. Other materials, such as glass-filled ABS may also be utilized. Material selection for most of the components may be based on the proposed use of the locking system. Appropriate materials may be selected for mounting systems used on particularly heavy panels, as well as on hinges subject to certain environmental conditions (e.g., moisture, corrosive atmospheres, etc.).

Any number of features of the different examples described herein may be combined into one single example and alternate examples having fewer than or more than all the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An electronic keeper comprising:

a housing defining an interior cavity, the housing having a first end, an opposite second end, and a wall;

a face plate coupled to the first end of the housing;

a back plate disposed at the second end of the housing, wherein the wall extends between the face plate and the back plate separating the interior cavity into a battery chamber and a discrete actuator chamber;

an actuator at least partially disposed within the actuator chamber, wherein the actuator comprises a strike and a magnet on opposing ends, wherein the actuator is pivotable between a first position and a second position relative to the housing, and wherein the actuator is biased towards the first position; and a sensor disposed within the battery chamber, wherein the magnet is positioned proximate the sensor on opposite sides of the wall, and wherein when a locking element is in contact with the strike, the actuator pivots from the first position towards the second position so that the magnet moves relative to the sensor.

2. The electronic keeper of claim 1, wherein the battery chamber is sealed to prevent exposure to corrosive conditions.

3. The electronic keeper of claim 1, wherein the magnet defines an axis, and wherein the axis is substantially parallel to a depth of the wall.

4. The electronic keeper of claim 1, wherein the face plate defines an opening for access into the actuator chamber.

5. The electronic keeper of claim 4, wherein the actuator is completely disposed within the actuator chamber, and wherein the strike is positioned proximate the opening.

6. The electronic keeper of claim 5, wherein the opening is configured to at least partially receive the locking element to contact the strike within the actuator chamber.

7. The electronic keeper of claim 4, further comprising a strike plate coupled to the face plate opposite the housing and proximate the opening, wherein the strike plate at least partially defines a lock volume configured to at least partially receive the locking element.

8. The electronic keeper of claim 7, wherein at least the strike of the actuator extends from the actuator chamber and into the lock volume when the actuator is in the first position.

9. The electronic keeper of claim 7, wherein the actuator further comprises a stop plate that the strike extends from, and wherein when the actuator is in the first position, the stop plate at least partially engages the face plate.

10. The electronic keeper of claim 9, wherein the actuator further comprises a lever arm extending between the stop plate and the strike.

11. The electronic keeper of claim 7, wherein when the actuator is in the second position, the strike is completely disposed within the actuator chamber.

12. The electronic keeper of claim 7, wherein the actuator further comprises a first member having the strike and a second member having the magnet, and wherein the first member is pivotably mounted within the actuator chamber and is pivotable in a first direction from the first position towards the second position, and the second member is pivotably mounted within the actuator chamber and is pivotable in an opposite second direction from the first position towards the second position.

13. The electronic keeper of claim 12, wherein the first member further comprises a stop plate that the strike extends from, and wherein the stop plate engages with the second member.

14. The electronic keeper of claim 4, wherein when the actuator is in the first position, the strike is angled to receive the locking element rotating in a first direction, and wherein the first direction is opposite to a second direction that the actuator pivots when moving from the first position towards the second position.

15. The electronic keeper of claim 4, wherein at least a portion of the back plate is secured to the housing by ultrasonic welding both a butt joint and a shear joint between the housing and the back plate.

16. An electronic keeper comprising:

a first compartment configured to at least partially receive a locking element;

an actuator disposed within the first compartment, wherein the actuator comprises a strike and a magnet on opposing ends, and wherein the strike is configured to contact at least a portion of the locking element and move the magnet from a first position towards a second position;

a second compartment separately sealed from the first compartment at least partially by a wall; and a sensor disposed within the second compartment and configured to detect the position of the magnet in at least one of the first position and the second position, wherein the magnet is positioned proximate the sensor on opposite sides of the wall.

17. The electronic keeper of claim 16, wherein the actuator comprises a first member having the strike and a separate second member having the magnet.

18. An electronic keeper comprising:

a housing defining a battery chamber and an actuator chamber;

a face plate coupled to a first end of the housing, wherein the face plate defines an opening for access into the actuator chamber;

an actuator at least partially disposed within the actuator chamber, wherein the actuator comprises a strike and a magnet, wherein the actuator is pivotable between a first position and a second position relative to the housing, and wherein the actuator is biased towards the first position; and a sensor disposed within the battery chamber, wherein when a locking element is in contact with the strike, the actuator pivots from the first position towards the second position so that the magnet moves relative to the sensor, and wherein the actuator is completely disposed within the actuator chamber, and wherein the strike is positioned proximate the opening and the magnet is positioned proximate the sensor.

* * * * *